US007934476B2

(12) United States Patent
Yamamoto et al.

(10) Patent No.: US 7,934,476 B2
(45) Date of Patent: May 3, 2011

(54) VALVE-ACTUATING SYSTEM FOR AN INTERNAL COMBUSTION ENGINE, ENGINE INCORPORATING SAME, AND METHOD OF USING SAME

(75) Inventors: Toshio Yamamoto, Saitama (JP); Takuya Warashina, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 327 days.

(21) Appl. No.: 12/082,440

(22) Filed: Apr. 11, 2008

(65) Prior Publication Data

US 2008/0264369 A1 Oct. 30, 2008

(30) Foreign Application Priority Data

Apr. 25, 2007 (JP) ..... 2007-115493

(51) Int. Cl.
*F01L 1/34* (2006.01)

(52) U.S. Cl. ..... 123/90.16; 123/90.39; 74/569

(58) Field of Classification Search ..... 123/90.16, 123/90.39; 74/569
See application file for complete search history.

(56) References Cited

U.S. PATENT DOCUMENTS

| | | | | |
|---|---|---|---|---|
| 3,878,822 | A | 4/1975 | Beal | |
| 4,253,434 | A | 3/1981 | Takizawa et al. | |
| 4,354,460 | A | 10/1982 | Mae et al. | |
| 4,499,870 | A * | 2/1985 | Aoyama | 123/198 F |
| 4,534,323 | A | 8/1985 | Kato et al. | |
| 5,203,289 | A | 4/1993 | Hara et al. | |

FOREIGN PATENT DOCUMENTS

| | | |
|---|---|---|
| DE | 33 16446 A1 | 11/1983 |
| DE | 33 46 556 A1 | 7/1984 |
| DE | 33 15396 A1 | 10/1984 |
| DE | 195 44 242 A1 | 6/1996 |
| JP | 60-85205 | 5/1985 |
| JP | 2001-020710 | 1/2001 |

* cited by examiner

*Primary Examiner* — Zelalem Eshete
(74) *Attorney, Agent, or Firm* — Carrier Blackman & Associates, P.C.; William D. Blackman; Joseph P. Carrier

(57) ABSTRACT

A valve-actuating system for an engine, in which left and right rocker arms are moved in axial directions of a rocker arm shaft to one of a first operating position in which the rocker arms are allowed to abut on first cams, and a second operating position in which the rocker arms are allowed to abut on second cams. The rocker arm shaft is slidably supported by an engine frame so as to be movable in the axial directions thereof. During an engine operation, when the left and right rocker arms are about to be selectively moved to one of the operating positions, the rocker arm shaft is moved in advance to the same side of the selected one of the operating positions, and thereafter the left and right rocker arms are moved to the selected one of the operating position.

20 Claims, 22 Drawing Sheets

FIG. 6A
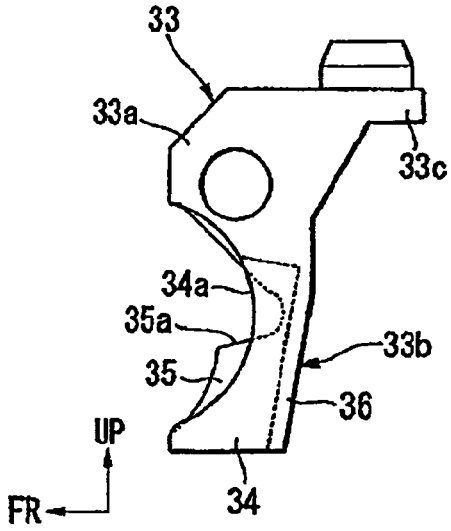
FIG. 6B
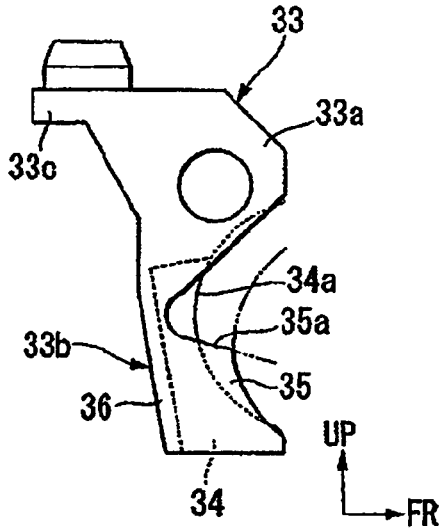
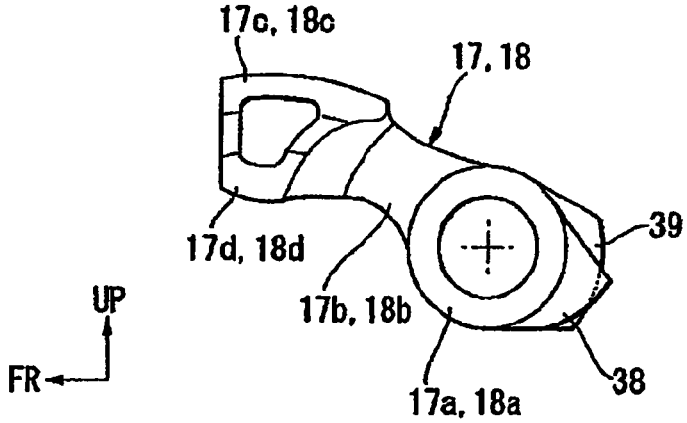
FIG. 7

VALVE-ACTUATING SYSTEM FOR AN INTERNAL COMBUSTION ENGINE, ENGINE INCORPORATING SAME, AND METHOD OF USING SAME

CROSS-REFERENCE TO RELATED APPLICATIONS

The present application claims priority under 35 USC §119 based on Japanese patent application No. 2007-115493 filed on Apr. 25, 2007. The entire subject matter of this priority document is incorporated by reference herein.

BACKGROUND OF THE INVENTION

1. Field of the Invention

The present invention relates to a variable valve-actuating system for a four-stroke engine of a vehicle such as a motorcycle, and to an engine incorporating same. More particularly, the present invention relates to a variable valve-actuating system including a camshaft having a pair of cams operatively associated with an engine valve, allowing one of the cams to be selectively used for opening and closing operations of the engine valve, and to a method of using same.

2. Description of the Background Art

There are number of known variable valve-actuating systems for internal combustion engines. Generally, such valve-actuating systems include a rocker arm shaft and a rocker arm. The rocker arm shaft is arranged in parallel with a camshaft having a pair of cams. The rocker arm is supported on the rocker arm shaft to be swingable about the axis of the rocker arm shaft, and is concurrently movable in the axial direction thereof.

In accordance with a rotational movement of the camshaft, the rocker arm abuts on one of the cams so as to be swung, thereby causing the engine valve to perform the opening and closing operations. Concurrently, the rocker arm is moved in the axial direction, as appropriate, so that one of the cams can be used for opening and closing the engine valve.

An example of such variable valve-actuating system for an internal combustion is disclosed in the Japanese Patent Application Laid-open No. 2001-20710.

Recently, there has been a demand that the engine respond smoothly to an operational request made by a driver of a vehicle to the engine during operation thereof. However, in the conventional technique such as disclosed in the Japanese Patent Application Laid-open No. 2001-20710, a foreign object may possibly be attached (or get attached during the engine operation) to the outer peripheral surface of the rocker arm shaft, on which the rocker arm is about to be moved. Since such a foreign object may interfere with the movement of the rocker arm, it becomes difficult for the rocker arm to be smoothly moved to a desired position on the rocker arm shaft.

The present invention has been made to overcome such drawbacks. Accordingly, an object of the present invention is to achieve a smooth movement of a rocker arm in a valve-actuating system of an engine, in which the rocker arm is moved in the directions of the axis of the swing of the rocker arm so as to achieve a variable cam for opening and closing the engine valve.

SUMMARY OF THE INVENTION

In order to achieve above objects, the present invention according to a first aspect thereof provides a valve-actuating system for an engine. The valve-actuating system for the engine includes a camshaft having a pair of first and second cams for an engine valve; and a rocker arm supported on a rocker arm shaft and being swingable around the axis of the rocker arm shaft, and being concurrently movable in the axial directions thereof. The rocker arm shaft is arranged in parallel with the camshaft.

In the valve-actuating system of the first aspect, in accordance with a rotational movement of the camshaft, the rocker arm abuts on one of the cams so as to be swung, thereby causing the engine valve to perform the opening and closing operations. In addition, the rocker arm is moved in the axial direction to one of a first operating position where the rocker arm is allowed to abut on the first cam, and a second operating position where the rocker arm is allowed to abut on the second cam, so that a corresponding one of the cams can be selectively used for opening and closing the engine valve.

The valve-actuating system for the engine according to the first aspect is specifically characterized in that the rocker arm shaft is slidably supported by an engine frame (e.g., a cylinder head), and that the rocker arm shaft is movable in the axial directions thereof. In addition, when the rocker arm is about to be moved to one of the first and second operating positions, the rocker arm shaft is moved in advance to the same side as that position, and thereafter the rocker arm is moved to the corresponding operating position.

In a second aspect of the present invention, in addition to the first aspect, a first rocker-arm moving mechanism and a second rocker-arm moving mechanism are provided. The first rocker-arm moving mechanism includes a first spring for applying a force to the rocker arm in a direction from the first operating position side to the second operating position side. The second rocker-arm moving mechanism includes a second spring for applying a force to the rocker arm in a direction from the second operating position side to the first operating position side.

The second aspect of the invention is specifically characterized in that a predetermined force is accumulated in one of the first and second springs, in accordance with an axial movement of the rocker arm shaft, preceding that of the rocker arm. Thereafter, the rocker arm is moved to the corresponding operating position by utilizing the accumulated force of the spring.

In a third aspect of the present invention, in addition to the first aspect, a rocker-arm-movement restricting mechanism is provided for restricting the movement of the rocker arm in the axial directions with respect to the engine frame, until the predetermined force is accumulated in one of the first and second springs.

In a fourth aspect of the present invention, in addition to one of the second and third aspects, the first and second rocker-arm moving mechanisms respectively include first and second spring-receiving portions disposed on the rocker arm shaft. The first and second spring-receiving portions do not move relatively in an axial direction thereof, and engage (receive) a portion of the respective springs therein.

According to the present invention, in a state where the movement of the rocker arm in the axial directions with respect to the engine frame is restricted, the rocker arm shaft is moved in the axial direction with respect to the engine frame along with the spring-receiving portions, so that the predetermined force is accumulated in one of the springs.

According to the first aspect of the present invention, the outer peripheral surface of the rocker arm shaft, on the side to which the rocker arm is about to be moved, becomes virtually the same as the surface which has been just covered by the rocker arm per se. Such arrangement prevents a foreign object, which would otherwise interfere with the movement of the rocker arm, from being attached to the surface. Accordingly, the rocker arm can be smoothly moved. Moreover, even when such a foreign object enters between the rocker arm and the rocker arm shaft, the foreign object is discharged appropriately by a relative movement of the rocker arm and the rocker arm shaft. Accordingly the rocker arm can be maintained at favorable desirable position without sacrificing the performance of the valve-actuating system.

According to the second aspect of the present invention, along with the movement of the rocker arm shaft preceding that of the rocker arm, it is possible to remove a foreign object that may be present on the outer peripheral surface on the side to which the rocker arm is about to be moved, and simultaneously to accumulate a required force in one of the springs.

In addition, since the rocker arm is moved by a predetermined force accumulated in one of the springs, the movement of the rocker arm is less likely to be influenced by an oil temperature and the like in contrast to an arrangement utilizing an engine oil pressure for moving the rocker arm to a desired position. As a result, the rocker arm can be smoothly moved.

According to the third aspect of the present invention, the rocker arm is not moved before one of the springs accumulates the predetermined force. As a result, the rocker arm can be smoothly moved by utilizing the predetermined force accumulated in one of the springs.

According to the fourth aspect of the present invention, the predetermined force can be accumulated in one of the springs by moving the rocker arm shaft in the axial directions along with the spring-receiving portions. In other words, utilizing the rocker arm shaft as a part of the rocker-arm moving mechanism makes it possible to simplify the rocker-arm moving mechanism.

For a more complete understanding of the present invention, the reader is referred to the following detailed description section, which should be read in conjunction with the accompanying drawings.

BRIEF DESCRIPTION OF THE DRAWINGS

FIG. 6A is a left-side view showing a trigger arm of the variable valve-actuating mechanism.

FIG. 6B is a right-side view showing the trigger arm of the variable valve-actuating mechanism.

FIG. 7 is a left-side view showing overlapped left and right rocker arms of the variable valve-actuating mechanism.

DETAILED DESCRIPTION OF ILLUSTRATIVE EMBODIMENTS

It should be understood that only structures considered necessary for illustrating selected embodiments of the present invention are described herein. Other conventional structures, and those of ancillary and auxiliary components of the system, will be known and understood by those skilled in the art.

Hereinafter, several illustrative embodiments of the present invention are described with reference to the accompanied drawings. In these drawings, for convenience of descriptions, the arrows FR, LH, and UP denote the frontward direction, the leftward direction, and the upward direction, respectively, in relation to a vehicle traveling direction.

Figure 1:
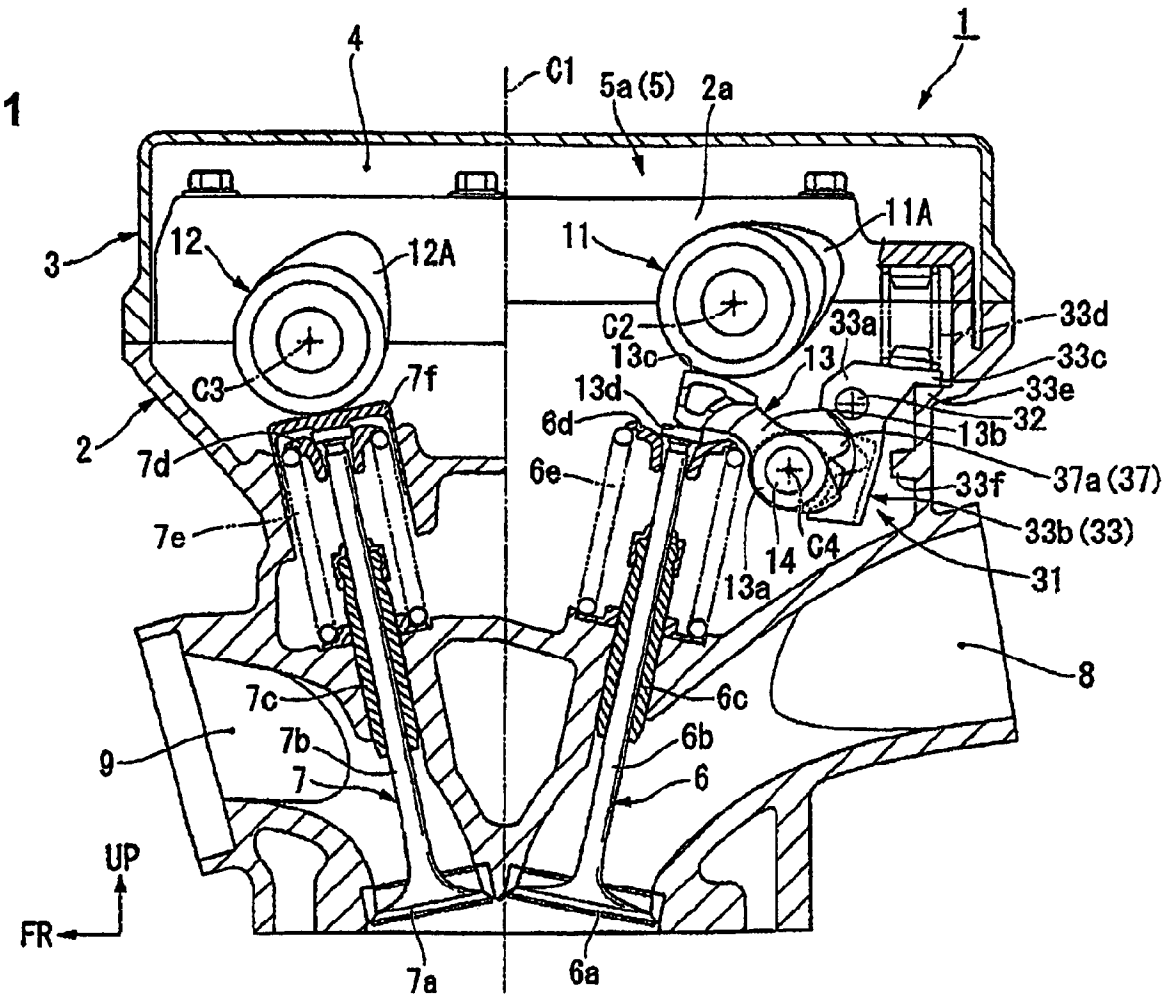
FIG. 1 is a left-side view showing a cylinder head of an engine according to an embodiment of the present invention.

FIG. 1 is a left-side view showing a cylinder head 2 of a four-stroke, DOHC, parallel, four-cylinder engine 1. The engine 1 is used as a power source for a vehicle such as a motorcycle. The engine 1 includes a head cover 3 attached on top of the cylinder head 2. A valve-actuating system 5 is housed in a valve chamber 4 formed by the cylinder head 2 and the head cover 3. The valve-actuating system 5 drives an intake valve 6 and an exhaust valve 7. In FIG. 1, a reference numeral C1 denotes the center axis (the cylinder axis) of a cylinder bore of a cylinder body.

An intake port 8 and an exhaust port 9 are formed in the cylinder head 2 for each cylinder. A plurality of combustion-chamber-side openings of the intake and exhaust ports 8 and 9 are opened and closed respectively by the intake and exhaust valves 6 and 7. The intake valve 6 includes an umbrella-shaped valve element 6*a* and a bar-shaped stem 6*b*. The exhaust valve 7 includes an umbrella-shaped valve element 7*a* and a bar-shaped stem 7*b*. The valve elements 6*a* and 7*a* fit into respective one of the corresponding combustion-chamber-side openings, while the bar-shaped stems 6*b* and 7*b* extend respectively from the valve elements 6*a* and 7*a*, toward the valve chamber 4. The stems 6*b* and 7*b* are reciprocatably supported by the cylinder head 2 respectively with cylindrical valve guides 6*c* and 7*c*.

Retainers 6*d* and 7*d* are attached to the end portions of the stems 6*b* and 7*b* of the respective valves 6 and 7. Valve springs 6*e* and 7*e* are each provided, in a compressed state, between the cylinder head 2 and a corresponding one of the retainers 6*d* and 7*d*. The valves 6 and 7 are thus biased upward respectively by the spring forces of the valve springs 6*e* and 7*e*, so that the valve elements 6*a* and 7*a* close off the corresponding combustion-chamber-side openings. On the other hand, when the valves 6 and 7 are moved downward against the biasing forces of the valve springs 6*e* and 7*e*, the valve elements 6*a* and 7*a* of the respective valves 6 and 7 are separated from, and thus open, the corresponding combustion-chamber-side openings.

The stems 6*b* and 7*b* of the respective valves 6 and 7 are each inclined to the cylinder axis C1, and thus form a V-shape when seen in a side view. An intake-side camshaft 11 and an exhaust-side camshaft 12, each aligned with the left and right directions, are arranged respectively above the stems 6*b* and 7*b*.

Each of the camshafts 11 and 12 is supported by the cylinder head 2 (including a shaft holder 2*a*) so as to be rotatable about the axis of the camshaft, and is rotationally driven in association with a crankshaft (not shown), for example, by using a chain-drive transmission system (not shown), during the operation of the engine 1. In the Figures, reference numerals C2 and C3 denote the center axes (the cam axes) of the camshafts 11 and 12, respectively.

Here, the engine 1 is a four-valve engine, and includes a pair of left and right sets of the intake and exhaust valves 6 and 7.

Each intake valve 6 is pressed by a cam 11A of the intake-side camshaft 11 with a rocker arm 13 in between, so as to perform the opening and closing operations. The rocker arm 13 is provided for each cylinder. On the other hand, each exhaust valve 7 is directly pressed by a cam 12A of the exhaust-side camshaft 12 with a valve lifter 7*f* in between, so as to perform the opening and closing operations. The valve lifter 7*f* is mounted on the end portion of the corresponding stem 7*b*.

The rocker arm 13 is supported on a rocker arm shaft 14 so as to be swingable about the axis of the rocker arm shaft 14. The rocker arm shaft 14 is arranged, in parallel with the intake-side camshaft 11, and behind the end portions of the stems 6*b* of the intake valves 6. In the figures, reference numeral C4 denotes the center axis (the rocker axis) of the rocker arm shaft 14.

The rocker arm 13 includes a cylindrical base portion 13*a* and an arm portion 13*b*. The rocker arm shaft 14 penetrates the base portion 13*a* of the rocker arm. The arm portion 13*b* extends from the base portion 13*a* toward the end portions of the stems 6*b* of the intake valves 6. A cam sliding contact portion 13*c* is provided at an upper side of the end portion of the arm portion 13*b*, while a valve pressing portion 13*d* is provided at a lower side of the end portion of the arm portion 13*b*. The cam 11A of the intake-side camshaft 11 is brought into sliding contact with the cam sliding contact portion 13*c*. The valve pressing portion 13*d* presses the end portions of the stems 6*b* downwardly When the intake-side camshaft 11 is rotationally driven during an operation of the engine 1, the cam 11A is brought into sliding contact with the cam sliding contact portion 13*c* to appropriately swing the rocker arm 13. The valve pressing portion 13*d* of the rocker arm 13 thus presses the end portion of the stem 6*b* of each intake valve 6, so as to appropriately reciprocate the intake valve 6 along the stem 6*b*, so that the corresponding combustion-chamber-side opening is opened and closed. In an embodiment, the rocker arm 13 may alternatively include a cam roller with which the cam 11A of the intake-side camshaft 11 is brought into rolling contact.

A variable valve-actuating mechanism 5*a* for changing the opening and closing timings and the lift amount of each intake valve 6 is disposed on the intake side of the valve-actuating system 5 of the engine 1. In a low speed range where the engine speed is, for example, lower than 6000 rpm (Revolutions Per Minute), the variable valve-actuating mechanism 5*a* causes each intake valve 6 to perform the opening and closing operations by using a low-engine-speed cam of the intake-side camshaft 11. On the other hand, in a high speed range where the engine speed is, for example, not less than 6000 rpm, the variable valve-actuating mechanism 5*a* causes each intake valve 6 to perform the opening and closing operations by using a high-engine-speed cam of the intake-side camshaft 11.

Hereinafter, the variable valve-actuating mechanism 5*a* is described for one cylinder. The other cylinders are assumed to have the same configuration, and therefore, a description thereof is omitted here.

Figure 2:
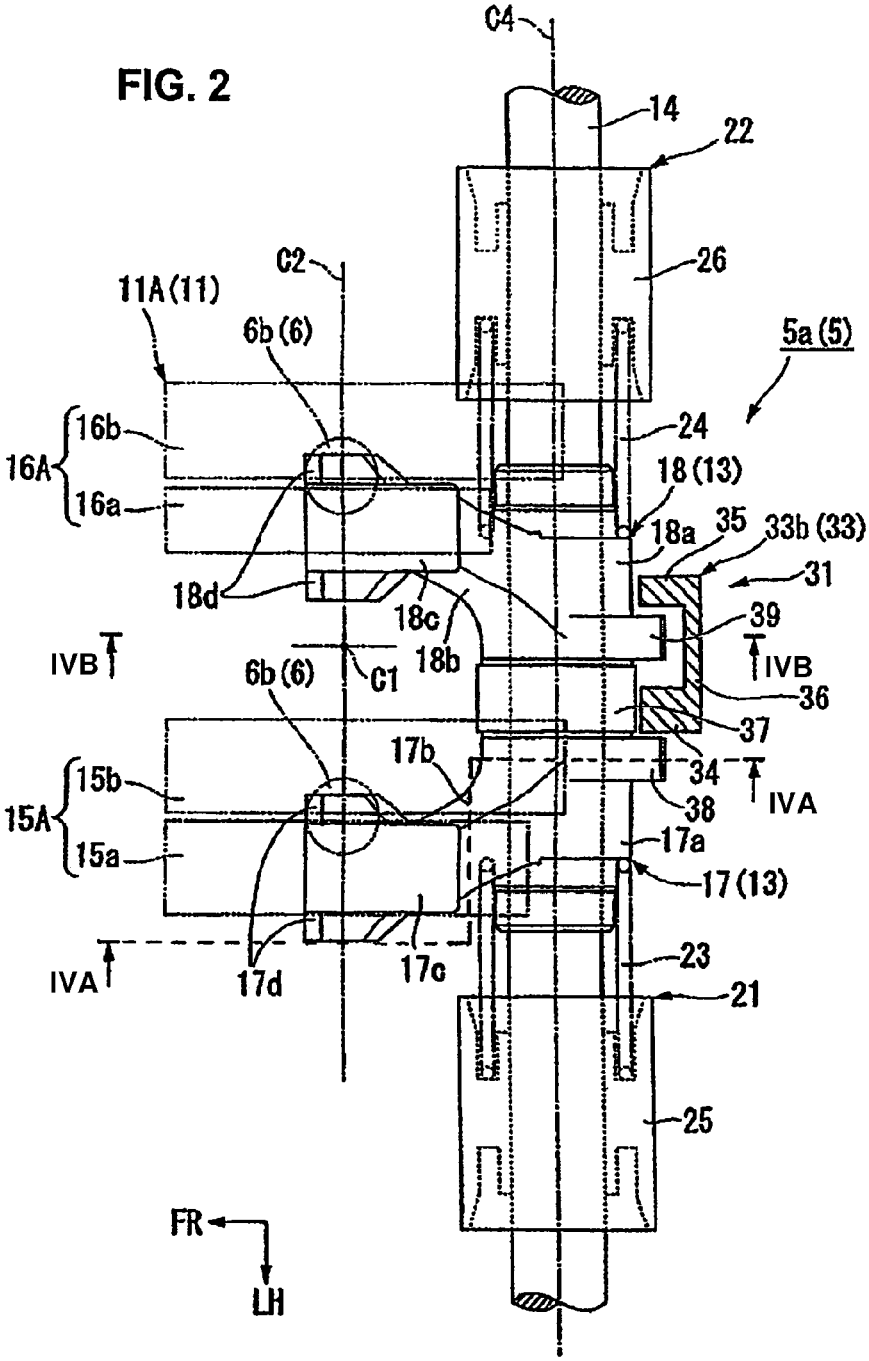
FIG. 2 is a top view showing a main part of a variable valve-actuating mechanism of the engine during a low speed operation.

As shown in FIG. 2, the cam 11A of the intake-side camshaft 11 includes left and right first cams 15*a* and 16*a* for the low speed range, which correspond respectively to the left and right intake valves 6; and left and right second cams 15*b* and 16*b* for the high speed range, which correspond respectively to the left and right intake valves 6. In other words, for each cylinder, the intake-side camshaft 11 has four cams in total, that is, the left and right first cams 15*a* and 16*a* and the left and right second cams 15*b* and 16*b*, for the corresponding left and right intake valves 6.

Hereinafter, the pair of the first cam 15*a* and the second cam 15*b*, corresponding to the left intake valve 6, is referred to as a left cam pair 15A, and the pair of the first cam 16*a* and the second cam 16*b*, corresponding to the right intake valve 6, is referred to as a right cam pair 16A. The left and right cam pairs 15A and 16A are substantially symmetrically disposed at positions respectively on the left and right sides of the cylinder axis C1 such that the cylinder axis C1 lies therebetween.

In addition, the left and right cam pairs 15A and 16A are spaced apart from each other at a predetermined interval in the directions of the cam axis. Moreover, in the left and right cam pairs 15A and 16A, each of the first cams 15*a* and 16*a*, and the corresponding one of the second cams 15*b* and 16*b* are arranged respectively on the left and right sides, and to be adjacent to each other in the directions of the cam axis.

Further, the rocker arm 13 is supported on the rocker arm shaft 14 to be swingable about the axis (the rocker shaft axis C4) of the rocker arm shaft 14, and concurrently to be movable in the axial directions (the directions along the rocker shaft axis C4) of the rocker arm shaft 14.

The rocker arm 13 is divided into arm segments, that is, the rocker arm 13 includes left and right rocker arm segments 17 and 18 which are independently operable relative to each other. In other words, the left and right rocker arm segments 17, 18 are swingable, relative to each other, about the axis, and concurrently movable, relative to each other, in the axial directions. The left and right rocker arm segments 17 and 18 correspond with the left and right intake valves 6 respectively. These left and right rocker arm segments 17 and 18 are independently swung respectively by the left and right first cams 15*a* and 16*a*, or respectively by the left and right second cams 15*b* and 16*b*, so as to cause the corresponding intake valves 6 to perform the opening and closing operations. The left and right rocker arm segments 17, 18 are also referred to herein as left and right rocker arms 17, 18.

The left and right rocker arms 17 and 18 include left and right base portions 17*a* and 18*a*, left and right arm portions 17*b* and 18*b*, left and right cam sliding contact portions 17*c* and 18*c*, and left and right valve pressing portions 17*d* and 18*d*, respectively. The left arm portion 17*b*, the left cam sliding contact portion 17*c*, the left valve pressing portion 17*d* are offset outwardly to the left of the left base portion 17*a*. In a similar manner, the right arm portion 18*b*, the right cam sliding contact portion 18*c*, the right valve pressing portion 18*d* are offset outwardly to the left of the right base portion 18*a*.

As shown in FIG. 4, each of the first and second cams 15*a*, 16*a*, 15*b*, and 16*b* has a zero-lift face F1 and a lift face F2 formed therein. Each zero-lift face F1 has a cylindrical profile of the substantially same diameter, and has concurrently the cam axis C2 as the center. Each lift face F2 has a lobe profile protruding to the outer peripheral side than the zero-lift faces F1. When the zero-lift face F1 of each of the cams 15*a*, 16*a*, 15*b*, and 16*b* faces the corresponding one of the cam sliding contact portions 17*c* and 18*c* of the respective left and right rocker arms 17 and 18, the corresponding intake valve 6 is brought into a valve-closed state where the intake valve 6 is completely closed (where the lift amount is zero).

On the other hand, when the lift face F2 faces the corresponding one of the cam sliding contact portions 17*c* and 18*c*, the corresponding intake valve 6 is brought into a valve-opened state where the intake valve 6 is opened by a predetermined amount (where the lift amount is the predetermined amount).

The protruding amount (the lift amount) of each of the first cams 15*a* and 16*a* of the respective left and right cam pair 15A and 16A is formed to be smaller than that of each of the second cams 15*b* and 16*b* thereof. In addition, the protruding amounts and the shapes of the lift faces F2 of the respective left and right cam pairs 15A and 16A are formed to be the substantially similar as each other. On the other hand, for example, the protruding amount of the lift face F2 of the first cam 16*a* of the right cam pair 16A is formed to be smaller than that of the left cam pair 15A.

Such configuration of the left and right cam pairs 15A, 16A increases the intake flow rate when the engine 1 is in the low speed range, and concurrently increases the difference in intake amount at the time of cam switching, thus enhancing the change in the intake performance. The lift amount of the first cam 16*a* of the right cam pair 16A may be set to at zero. Alternatively, the protruding amounts of the lift faces F2 of the respective first cams 15*a* and 16*a* may be set to be equal to each other.

The left and right rocker arms 17 and 18 are biased to the inner side, in the left and right directions, of the cylinder respectively by first and second rocker-arm moving mechanisms 21 and 22 (described later). The base portions 17*a* and 18*a* of these rocker arms 17 and 18 thus abut on each other with a center collar 37 (described later) sandwiched therebetween in the axial directions of the rocker arm shaft 14. In this state, the rocker arms 17 and 18 are supported on the rocker arm shaft 14 so as to be integrally movable in the axial directions thereof.

When the engine 1 is not operating, or is operating in the low speed range, the left and right rocker arms 17 and 18 are located at a leftward-movement limit position in the axial directions. In this state, the cam sliding contact portions 17*c* and 18*c* of the left and right rocker arms 17 and 18 are located at positions below the first cams 15*a* and 16*a* of the left and right cam pairs 15A and 16A, respectively, where the cam sliding contact portions 17*c* and 18*c* are allowed to be brought into sliding contact with the peripheral surfaces (the cam surfaces) of the first cams 15*a* and 16*a*.

Each of the valve pressing portions 17*d* and 18*d* of the left and right rocker arms 17 and 18 is provided to have a width wider, in the left and right directions, than that of the corresponding one of the cam sliding contact portions 17*c* and 18*c*. When the left and right rocker arms 17 and 18 are located at the leftward-movement limit position, the right end portions of the valve pressing portions 17*d* and 18*d* is disposed at positions where the valve pressing portions 17*d* and 18*d* are allowed to press the end portions of the stems 6*b* of the left and right intake valves 6, respectively. The position of the left and right rocker arms 17 and 18 in the axial directions at this time is called a first operating position.

Figure 3:
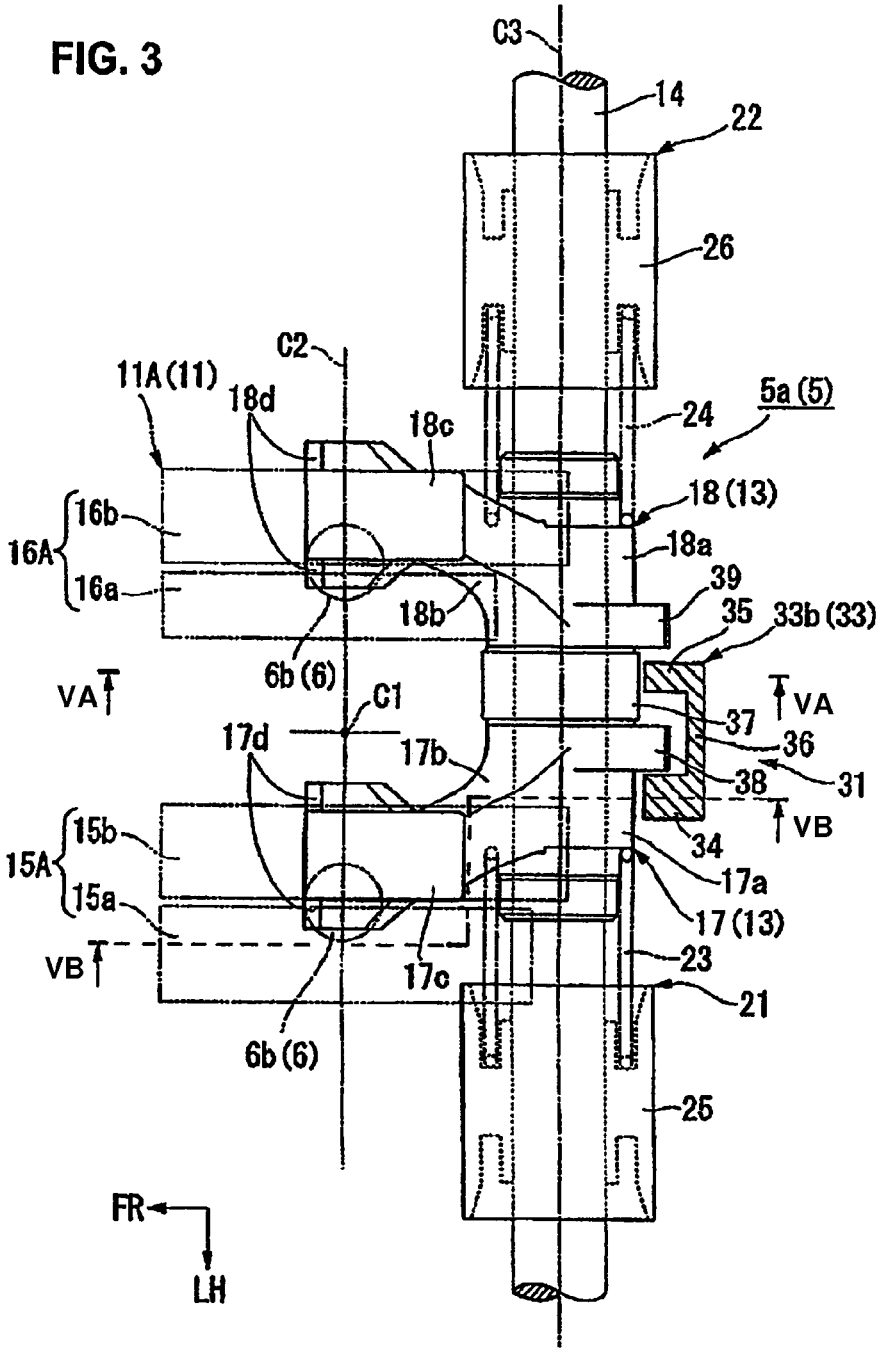
FIG. 3 is a top view showing a main part of the variable valve-actuating mechanism during a high speed operation.

As shown in FIG. 3, when the engine 1 is operating in the high speed range, the left and right rocker arms 17 and 18 are located at a rightward-movement limit position in the axial directions. In this state, the cam sliding contact portions 17*c* and 18*c* of the left and right rocker arms 17 and 18 are located at positions below the second cams 15*b* and 16*b* of the left and right cam pairs 15A and 16A, respectively, where the cam sliding contact portions 17*c* and 18*c* are allowed to be brought into sliding contact with the peripheral surfaces (the cam surfaces) of the second cams 15*b* and 16*b*.

When the left and right rocker arms 17 and 18 are located at the rightward-movement limit position, the left end portions of the valve pressing portions 17*d* and 18*d* of the left and right rocker arms 17 and 18 are disposed at positions where the pressing portions 17*d* and 18*d* are allowed to press the end portions of the stems 6*b* of the left and right intake valves 6, respectively. The position of the left and right rocker arms 17 and 18 in the axial directions at this time is called a second operation position.

In other words, the variable valve-actuating mechanism 5*a* operates the first and second rocker-arm moving mechanisms 21 and 22 in accordance with the engine speed. The left and right rocker arms 17 and 18 are thus moved to one of the first and second operating positions in the axial directions of the rocker arm shaft 14. In this way, the variable valve-actuating mechanism 5*a* allows one of the cams 15*a*, 16*a*, 15*b*, and 16*b* to be selectively used for opening and closing the left and right intake valves 6.

The first rocker-arm moving mechanism 21 includes a first spring 23 and a first spring receiving collar 25. The first spring 23 is positioned at the left side of the base portion 17*a* of the left rocker arm 17, and applies a force to the base portion 17*a* in a direction from the first operating position side (the low speed side) to the second operating position side (the high speed side). The first spring receiving collar 25 is positioned at the left side of the first spring 23, and is supported on the periphery of the rocker arm shaft 14 so as not to be relatively movable in the axial directions.

In a similar manner, the second rocker-arm moving mechanism 22 includes a second spring 24 and a second spring receiving collar 26. The second spring 24 is positioned at a right side of the base portion 18*a* of the right rocker arm 18, and applies a force to the base portion 18*a* in a direction from the second operating position side to the first operating position side. The second spring receiving collar 26 is positioned at the right side of the second spring 24, and is supported on the periphery of the rocker arm shaft 14 so as not to be relatively movable in the axial directions.

Each of the first and second springs 23 and 24 includes a helical compression spring provided in manner of being wound (i.e. coiled) around the periphery of the rocker arm shaft 14 (in the manner where the rocker arm shaft 14 penetrates the springs 23 and 24). The right end portion of the first spring 23 is fitted onto the outer periphery of the left side of the base portion 17*a* of the left rocker arm 17. The left end portion of the first spring 23 is fitted onto the inner periphery of the right side of the first spring receiving collar 25.

On the other hand, the left end portion of the second spring 24 is fitted onto the outer periphery of the right side of the base portion 18*a* of the right rocker arm 18. The right end portion of the second spring 24 is fitted onto the inner periphery of the left side of the second spring receiving collar 26.

The rocker arm shaft 14 is supported by the cylinder head 2 to be movable in the axial directions thereof, and concurrently to be rotatable about the axis thereof. The rocker shaft 14 may be slidably disposed in the cylinder head 2.

As shown in FIG. 2, when the engine 1 is not operating, or is operating in the low speed range, the rocker arm shaft 14, and the spring receiving collars 25 and 26, are located at the leftward-movement limit position in the axial direction. At that time, the left and right rocker arms 17 and 18 are located at the first operating position. Again, at the same time, the springs 23 and 24 are compressed by a predetermined initial amount between the spring receiving collar 25 and the base portion 17*a* of the left rocker arm 17, and between the spring receiving collar 26 and the base portion 18*a* of the right rocker arm 18, respectively. Initial loads of the respective springs 23 and 24 in this state are set to be of substantially similar magnitudes. Accordingly, the left and right rocker arms 17 and 18 are held at the first operating position.

On the other hand, as shown in FIG. 3, when the engine 1 is operating in the high speed range, the rocker arm shaft 14 and the spring receiving collars 25 and 26 are located at the rightward-movement limit position in the axial directions. At that time, the left and right rocker arms 17 and 18 are located at the second operating position. Again, at the same time, the springs 23 and 24 are compressed in the initial compressed state, in a similar manner as discussed above, between the spring receiving collar 25 and the base portion 17*a* of the left rocker arm 17, and between the spring receiving collar 26 and the base portion 18*a* of the right rocker arm 18, respectively. Initial loads of the respective spring 23 and 24 in this state are also set to be of substantially similar magnitudes. Accordingly, the left and right rocker arms 17 and 18 are held at the second operating position.

The amount of movement, in the axial directions, of the rocker arm shaft 14, and the spring receiving collars 25 and 26, (the amount of movement thereof from one of the movement limit positions to the other one) is the same as the amount of movement, in the axial directions, of the left and right rocker arms 17 and 18 (the amount of movement thereof from one of the operating positions to the other).

The movement, in the axial directions, of the left and right rocker arms 17 and 18 with respect to the cylinder head 2 is restricted by a rocker-arm-movement restricting mechanism 31 (described later). In this state, a predetermined difference in elastic force is generated between the springs 23 and 24 when the rocker arm shaft 14 and the spring receiving collars 25 and 26, are integrally moved in the axial directions with respect to the cylinder head 2.

Specifically, when the rocker arm shaft 14 and the spring receiving collars 25 and 26, are moved with respect to the cylinder head 2, from the leftward-movement limit position to the rightward-movement limit position, the first spring 23 is compressed by the amount of the movement to thus increase its elastic force, while the second spring 24 is conversely extended to thus decrease its elastic force.

On the other hand, when the rocker arm shaft 14 and the spring receiving collars 25, 26, are moved with respect to the cylinder head 2, from the rightward-movement limit position to the leftward-movement limit position, the second spring 24 is compressed by the amount of the movement to thus increase its elastic force, while the first spring 23 is conversely extended to thus decrease its elastic force.

As discussed above, by utilizing the difference in elastic force of the first and second sperings (hereinafter, referred to as an elastic force accumulated in one of the springs 23 and 24), the left and right rocker arms 17 and 18 are moved from one of the first and second operating positions to the other one of the first and second operating positions. It may be noted that, the amount of the extension for each of the springs 23 and 24 is the amount of the initial compression thereof.

The rocker-arm-movement restricting mechanism 31 restricts the movement of the left and right rocker arms 17 and 18 in the axial directions until a predetermined elastic force is accumulated in one of the springs 23 and 24.

The rocker-arm-movement restricting mechanism 31 includes a support shaft 32, a trigger arm 33, and the center collar 37. The support shaft 32 is arranged in parallel with the rocker arm shaft 14. The trigger arm 33 is supported by the cylinder head 2 with the support shaft 32 disposed therebetween so as to be swingable about the axis of the support shaft 32, but concurrently not to be movable in the axial directions thereof. The center collar 37 is supported on the rocker arm shaft 14 at a position between the base portions 17*a* and 18*a* of the left and right rocker arms 17 and 18, so as not to be relatively rotatable about the axis of the rocker arm shaft 14, but concurrently to be relatively movable in the axial directions thereof.

The trigger arm 33 is positioned behind the rocker arm shaft 14, and is provided to be bilaterally symmetric with respect to the cylinder axis C1. The support shaft 32 supporting the trigger arm 33 is positioned obliquely above and behind the rocker arm shaft 14. The trigger arm 33 includes a base portion 33*a* and an arm portion 33*b* extending downwardly from the base portion 33*a*. The support shaft is inserted 32 is inserted through the trigger arm 33. The arm portion 33*b* has a "U" shape in the cross section, and includes left and right sidewall portion 34 and 35 (also referred as left and right trigger-side key portions 34 and 35, respectively), and a rear wall portion 36.

As shown in FIG. 6, the trigger arm 33 includes left and right cutout portions 34*a* and 35*a* disposed on the left and right sidewall portions 34 and 35 of the arm portion 33*b* respectively. The left and right cutout portions 34*a* and 35*a* face frontward, and have different shapes when viewed in the side view. Specifically, the left cutout portion 34*a* is formed into a semicircular shape extending from the lower portion of the base portion 33*a* to the tip side of the arm portion 33*b* in the side view.

On the other hand, the right cutout portion 35*a* is formed into a shape in which a semicircular shape and a chevron shape vertically overlap each other to a predetermined extent. The lower portion of the right cutout portion 35*a* is formed into the semicircular shape with a diameter smaller than that of the left cutout portion 34*a*, while the upper portion thereof is formed into the chevron shape protruding rearward of the left cutout portion 34*a* in the side view.

A stopper portion 33*c* is provided at the rear side of the base portion 33*a* of the trigger arm 33. The stopper portion 33*c* extends rearward to have substantially horizontal plate shape. As shown in FIG. 1, a spring 33*d* (also referred as a compression coil spring 33*d*) is disposed between the cylinder head 2 and the stopper portion 33*c* in a compressed state. The stopper portion 33*c* receives the elastic force of the spring 33*d*, and concurrently abuts, at the lower surface thereof, on the upper surface of a stopper receiving portion 33*e* of the cylinder head 2. Accordingly, the stopper portion 33*c* restricts the rotation (the swing) of the trigger arm 33 in a right-hand (a clockwise: CW) direction as viewed in FIGS. 1 and 4, and the corresponding figures.

When the trigger arm 33 is biased in the right-hand direction by the spring 33*d* (as viewed in FIG. 1, 4, and the corresponding figures), so as to be held in a state where the arm portion 33*b* is positioned close to the rear of the rocker arm shaft 14, the state of the trigger arm 33 is referred to as a pre-swing state of the trigger arm 33.

A swing restricting portion 33*f* is disposed in the inner wall surface of the cylinder head 2, at a position behind the arm portion 33*b*. The spring restricting portion 33*e* is allowed to abut on the rear surface of the trigger arm 33 when the trigger arm 33 rotates in the left-hand direction (counterclockwise direction: CCW) as viewed in FIG. 1, 4 and the corresponding figures. The spring restricting portion 33*e* thus restricts the swing angle of the trigger arm 33 when the trigger arm 33 swings against the biasing force of the spring 33*d*. In an embodiment of the present invention, the swing restricting portion may alternatively be provided on the rear surface of the trigger arm 33.

As shown in FIGS. 2, 4, and 7, left and right rocker-side key portions 38 and 39 are disposed in the rear sides of the base portions 17*a* and 18*a* of respective left and right rocker arms 17 and 18. The left and right rocker-side key portions 38 and 39 protrude rearward to have shapes different from each other when viewed in a side view. Specifically, the left rocker-side key portion 38 is formed into a chevron shape in the side view on the rear side of the right end portion of the left base portion 17*a*, and has a wall shape perpendicular to the left and right directions. The lower portion of the left rocker-side key portion 38 is formed into an arch shape in contact with the tangent line to the lower end of the base portion 17*a* in the side view.

On the other hand, the right rocker-side key portion 39 is formed into a substantially trapezoidal shape in the side view on the rear side of the left end portion of the right base portion 18*a*, and has a wall shape perpendicular to the left and right directions. The rear portion of the right rocker-side key portion 39 is formed into an arch shape which is substantially coaxial with the rocker arm shaft 14 in the side view.

When the left and right rocker arms 17 and 18 are located at the first operating position, the left rocker-side key portion 38 is located adjacent to the left side of the left trigger-side key portion 34 of the trigger arm 33 (see FIG. 2). When the left and right rocker arms 17 and 18 are located at the second operating position, the left rocker-side key portion 38 is located adjacent to the right side of the left trigger-side key portion 34 (see FIG. 3). When the trigger arm 33 is in the pre-swing state, the left trigger-side key portion 34 of the trigger arm 33 overlaps the left rocker-side key portion 38 to a predetermined extent when viewed in the axial directions.

On the other hand, when the left and right rocker arms 17 and 18 are located at the first operating position, the right rocker-side key portion 39 is located adjacent to the left side of the right trigger-side key portion 35 of the trigger arm 33 (see FIG. 2). When the left and right rocker arms 17 and 18 are located at the second operating position, the right rocker-side key portion 39 is located adjacent to the right side of the right trigger-side key portion 35 (see FIG. 3). When the trigger arm 33 is in the pre-swing state, the right trigger-side key portion 35 of the trigger arm 33 overlaps the right rocker-side key portion 39 to a predetermined extent as viewed in the axial directions.

During an operation of the engine, a predetermined clearance is formed in the axial directions between two adjacent portions of the left and right rocker-side key portions 38 and 39 and the left and right trigger-side key portions 34 and 35. Specifically, the clearance is formed in a state where the force of each of the rocker-arm moving mechanisms 21 and 22 is not applied to the left and right rocker arms 17 and 18 (in a state where each of the springs 23 and 24 is compressed by the predetermined initial amount, that is, in a state where the forces applied to the left and right rocker arms 17 and 18 by the respective springs 23 and 24 are the same) (see FIGS. 2 and 3).

Figure 8A:
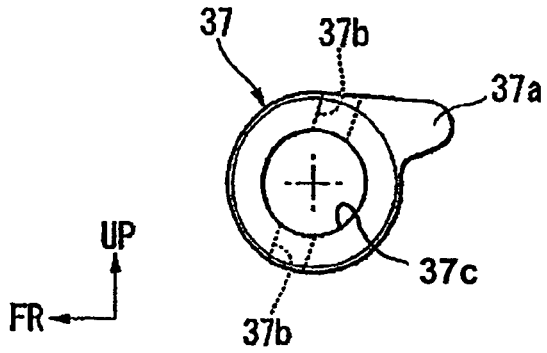
FIG. 8A is a left-side view showing a center collar of the variable valve-actuating mechanism.
Figure 8B:
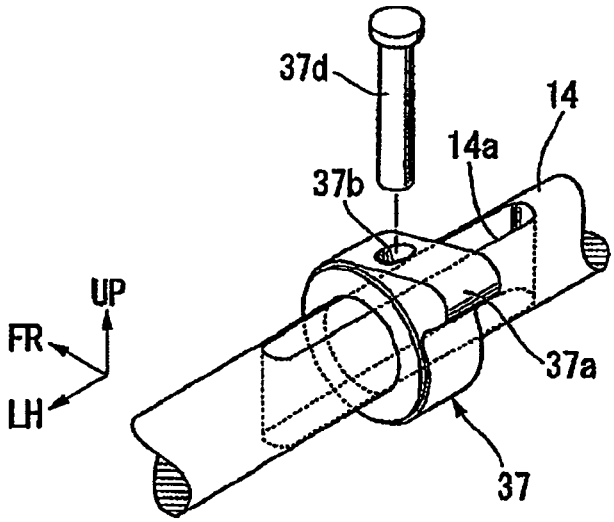
FIG. 8B is a perspective view showing a state where the center collar is mounted on a rocker arm shaft.

As shown in FIG. 8, the center collar 37 has a ring-shaped structure having substantially similar diameter as those of the base portions 17*a* and 18*a* of the left and right rocker arms 17 and 18. A center cam portion 37*a* is formed on the rear side of the upper portion of the center collar 37. The center cam portion 37*a* extends rearward along a substantially horizontal tangent line. A through hole 37*b* is formed in the center collar 37 to penetrate the center collar 37 in a radial direction. On the other hand, a slit 14*a* is formed at a predetermined position in the rocker arm shaft 14. The slit 14*a* penetrates the rocker arm shaft 14 in the radial direction of the rocker arm shaft 14 over a predetermined length in the axial directions thereof.

The center collar 37 is mounted at the predetermined position on the rocker arm shaft 14 by inserting the rocker arm shaft through a central bore 37*c* formed in the center collar 37. Then, the center collar 37 and the rocker arm shaft 14 are assembled with an engagement pin 37*d* penetrating the through hole 37*b* and the slit 14*a*. Accordingly, the center collar 37 is supported on the predetermined position on the rocker arm shaft 14 so as not to be relatively rotatable about the axis of the rocker arm shaft 14, but to be relatively movable in the axial directions thereof by the length of the slit 14*a*.

Figure 4B:
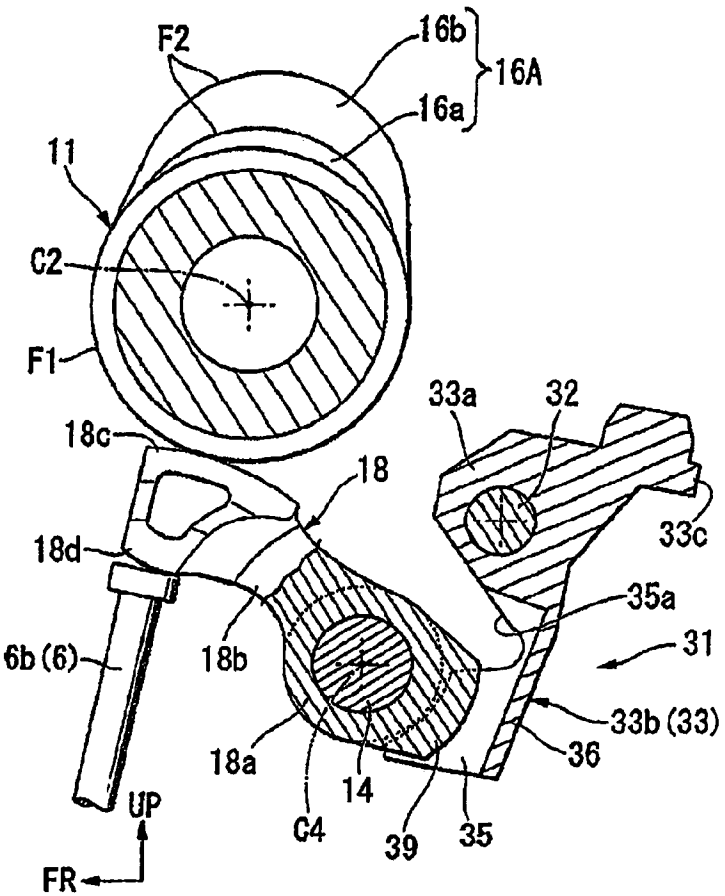
FIG. 4B is a cross-sectional view taken along the line IVB-IVB in FIG. 2.
Figure 4A:
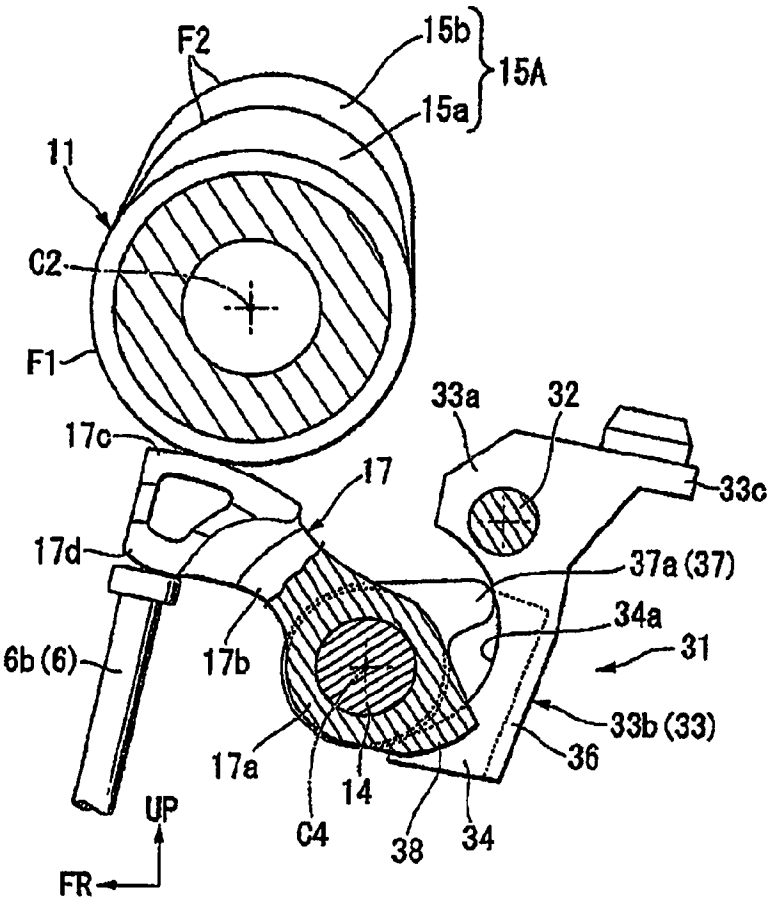
FIG. 4A is a cross-sectional view taken along the line IVA-IVA in FIG. 2.

As shown in FIGS. 2 and 4A, when the left and right rocker arms 17 and 18 are located at the first operating position, the center cam portion 37*a* is positioned inside the cutout portion 34*a* of the left trigger-side key portion 34 of the trigger arm 33. The tip portion of the center cam portion 37*a* is thus brought close to the inner peripheral surface of the upper portion of the left cutout portion 34*a*.

Figure 5B:
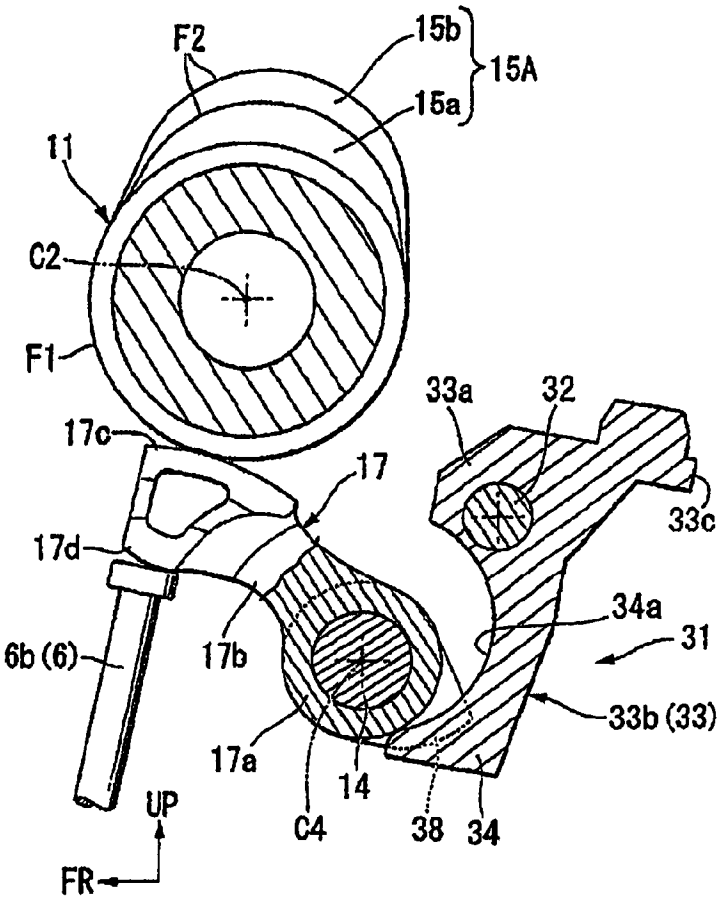
FIG. 5B is a cross-sectional view taken along the line VB-VB in FIG. 3.
Figure 5A:
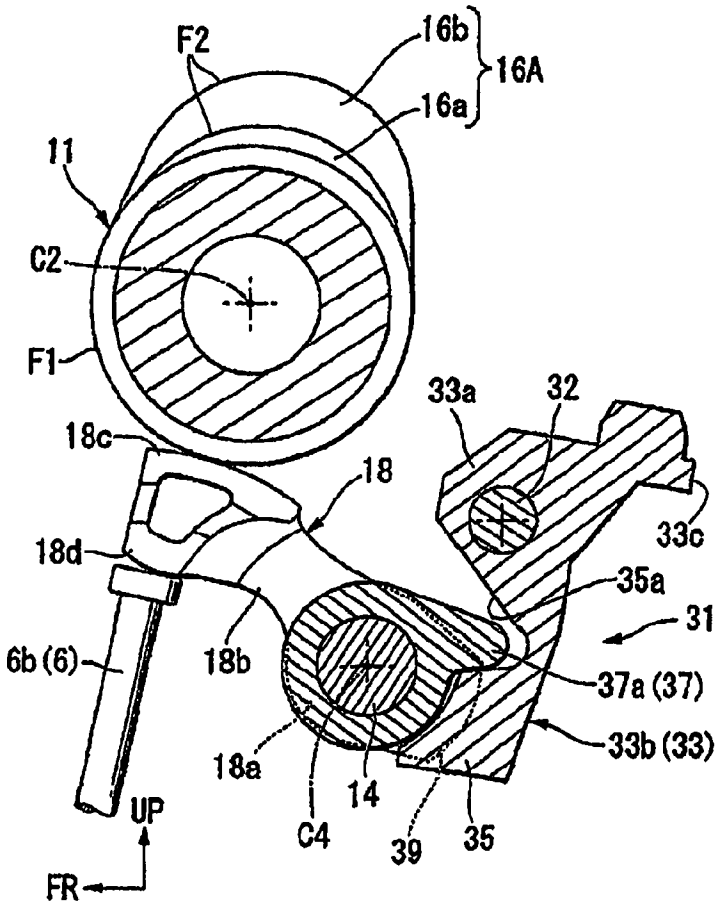
FIG. 5A is a cross-sectional view taken along the line VA-VA in FIG. 3.

On the other hand, as shown in FIGS. 3 and 5A, when the left and right rocker arms 17 and 18 are located at the second operating position, the center cam portion 37*a* is positioned inside the cutout portion 35*a* of the right trigger-side key portion 35 of the trigger arm 33. The tip portion of the center cam portion 37*a* is thus brought close to the inner peripheral surface of the upper portion of the right cutout portion 35*a*.

Here, the rocker arm shaft 14 is moved in the axial directions with respect to the cylinder head 2 by the operation of a shaft driving mechanism 41 (described later). Along with this movement, the rocker arm shaft 14 is allowed to rotate about the axial directions thereof. Specifically, when located at the leftward-movement limit position, the rocker arm shaft 14 is also located at a counterclockwise-rotation limit position about the axis thereof (as shown in FIGS. 4A-4B, and the corresponding figures). On the other hand, when located at the rightward -movement limit position, the rocker arm shaft 14 is also located at a clockwise-rotation limit position about the axis thereof (as shown in FIGS. 4A-4B, and the corresponding figures).

Figure 10B:
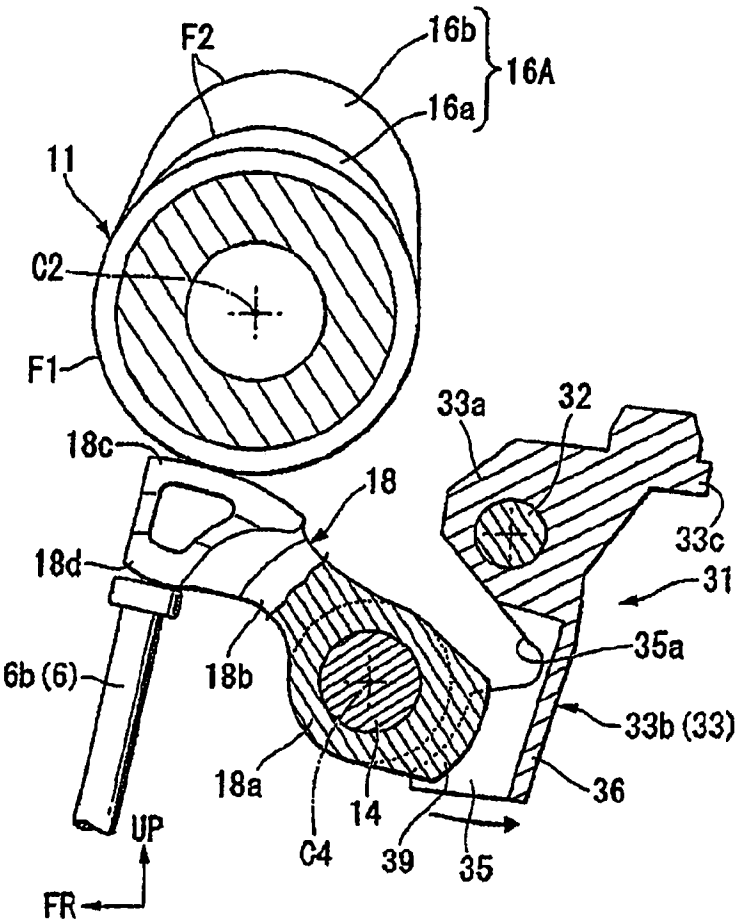
FIG. 10B is a cross-sectional view showing the first operation, and corresponding to FIG. 4B.
Figure 10A:
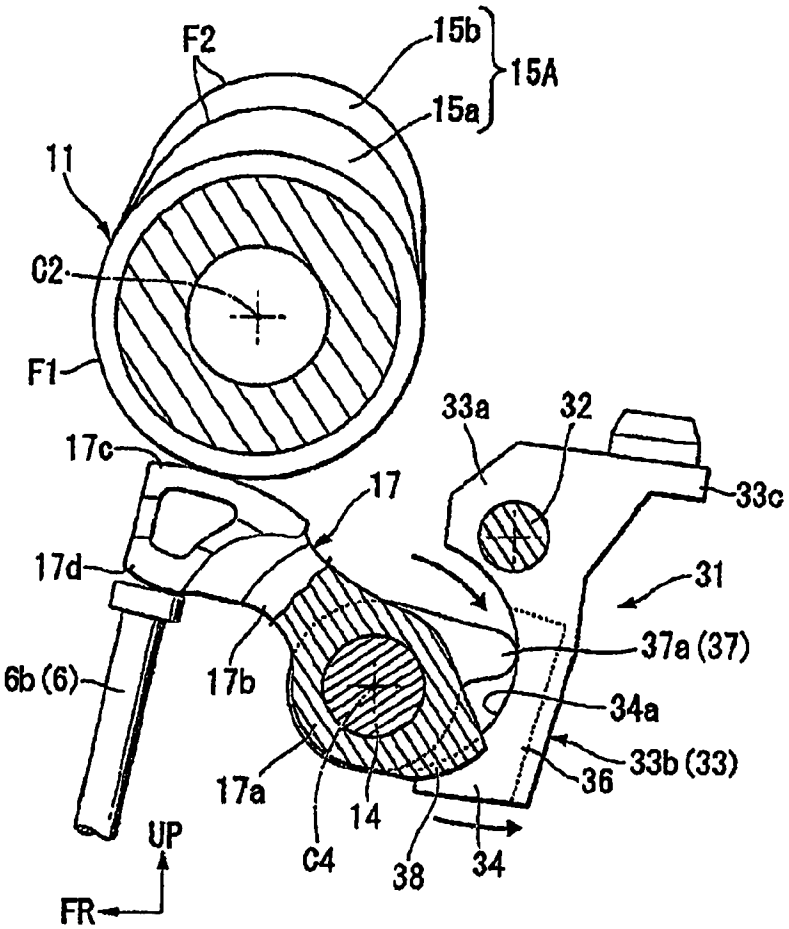
FIG. 10A is a cross-sectional view showing the first operation of the variable valve-actuating mechanism, and corresponding to FIG. 4A.

Along with the rotation of the rocker arm shaft 14, the center collar 37 also integrally rotates therewith (FIG. 10A). It may be noted that the position of the center collar 37 in the axial directions with respect to the rocker arm shaft 14 is changed in accordance with a combination of the slit 14*a* and the engagement pin 37*d*.

Figure 9:
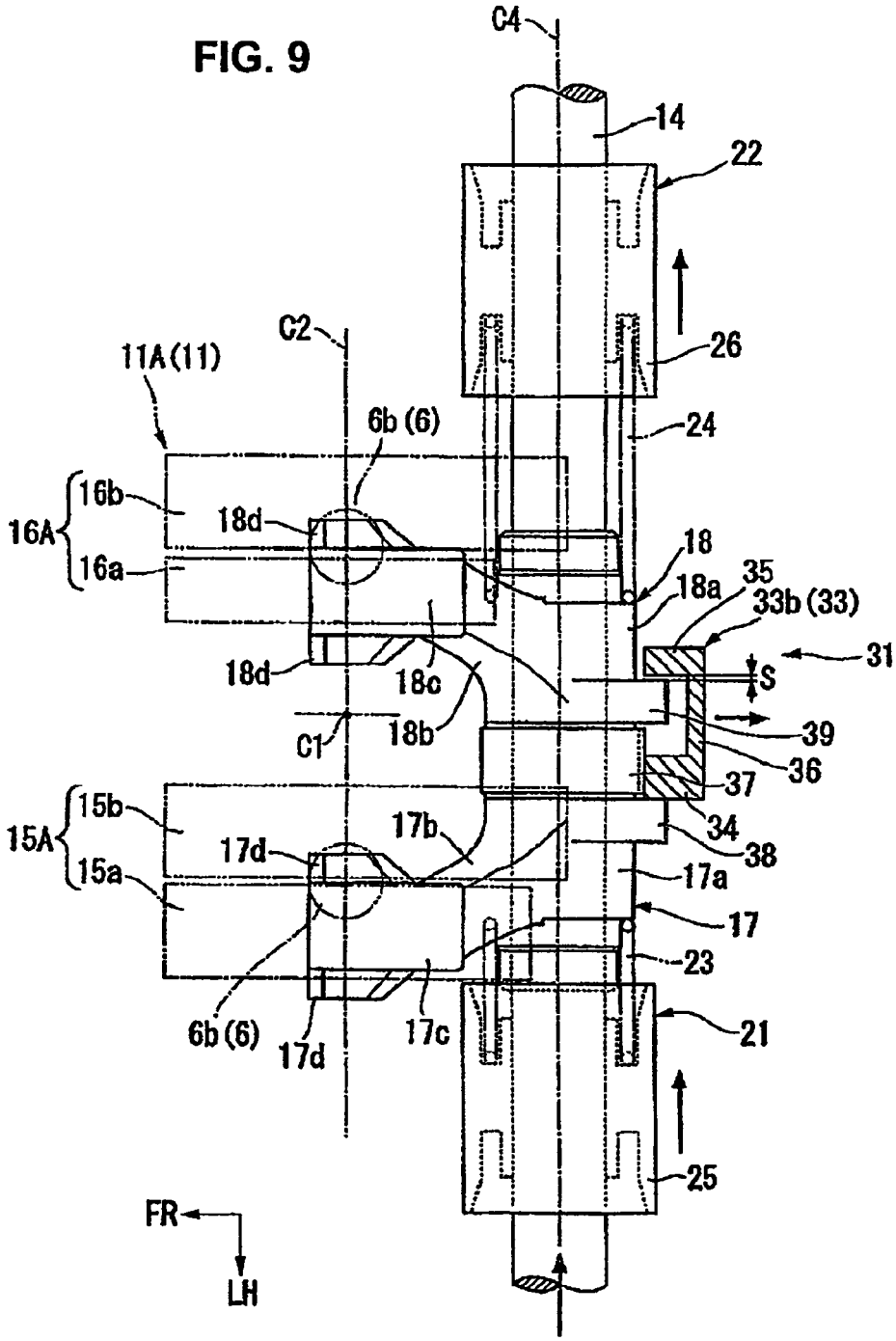
FIG. 9 is a top view showing a first operation of the variable valve-actuating mechanism, and corresponding to FIG. 2.

When the left and right rocker arms 17 and 18 are located at the first operating position, a predetermined force is accumulated in the first rocker-arm moving mechanism 21 in order to move the left and right rocker arms 17 and 18 to the second operating position. Firstly, as shown in FIG. 9, the shaft driving mechanism 41 is activated to move rightward, along with the spring receiving collars 25 and 26, the rocker arm shaft 14 located at the leftward-movement limit position At this time, the lower portion of the left rocker-side key portion 38 of the left rocker arm 17 and the lower portion of the left trigger-side key portion 34 of the trigger arm 33 overlap to the predetermined extent (when viewed in the axial directions). Accordingly, the lower portion of the left rocker-side key portion 38 and the lower portion of the left trigger-side key portion 34 abut on each other in the axial directions, so that the rightward movement of the left and right rocker arms 17 and 18 with respect to the trigger arm 33 (the cylinder head 2) is restricted at that position.

At this time, the rear portion of the right rocker-side key portion 39 of the right rocker arm 18 and the lower portion of the right trigger-side key portion 35 of the trigger arm 33 also overlap to the predetermined extent (when viewed in the axial directions). A predetermined space S is secured in the axial directions, between the rear portion of the right rocker-side key portion 39 and the lower portion of the right trigger-side key portion 35.

As shown in FIGS. 10A-10B, along with the rightward movement, the rocker arm shaft 14 rotates in the clockwise direction about the axis thereof. Along with the rotation of the rocker arm shaft 14, the center collar 37 also rotates in the clockwise direction. Accordingly, the outer peripheral surface of the tip portion of the center cam portion 37*a* is brought into sliding contact with the inner peripheral surface of the upper portion of the cutout portion 34*a* of the left trigger-side key portion 34 of the trigger arm 33 in the pre-swing state. As a result, the trigger arm 33 is caused to rotate in a counterclockwise direction against the biasing force of the spring 33*d*.

Further, when the rocker arm shaft 14 is moved to the rightward-movement limit position, the rotation of the center collar 37, which is associated with the movement of the rocker arm shaft 14, is terminated, and also the rotation of the trigger arm 33, which is associated with the rotation of the center collar 37, is terminated. At this moment, the lower portion of the left rocker-side key portion 38 and the lower portion of the left trigger-side key portion 34 still overlap while the overlap area as viewed in the axial directions is reduced.

Concurrently, the rear portion of the right rocker-side key portion 39 and the lower portion of the right trigger-side key portion 35 also still overlap although the overlap area as viewed in the axial directions is reduced. At this time, the lower portion of the cutout portion 35*a* of the right trigger-side key portion 35 has an arch shape which is substantially coaxial with the rocker arm shaft 14 as viewed in the axial directions. The state of the trigger arm 33 at this time is referred to as a first swing state of the trigger arm 33.

As discussed above, when the rocker arm shaft 14 and the spring receiving collars 25, 26, are moved from the leftward-movement limit position to the rightward-movement limit position, the first spring 23, located between the first spring receiving collar 25 and the base portion 17*a* of the left rocker arm 17 whose movement is restricted, is compressed by a predetermined amount (force). The first spring 23 is thus brought into a state where the first spring 23 has accumulated an elastic force capable of moving the left and right rocker arms 17 and 18 from the first operating position to the second operating position.

Figure 11B:
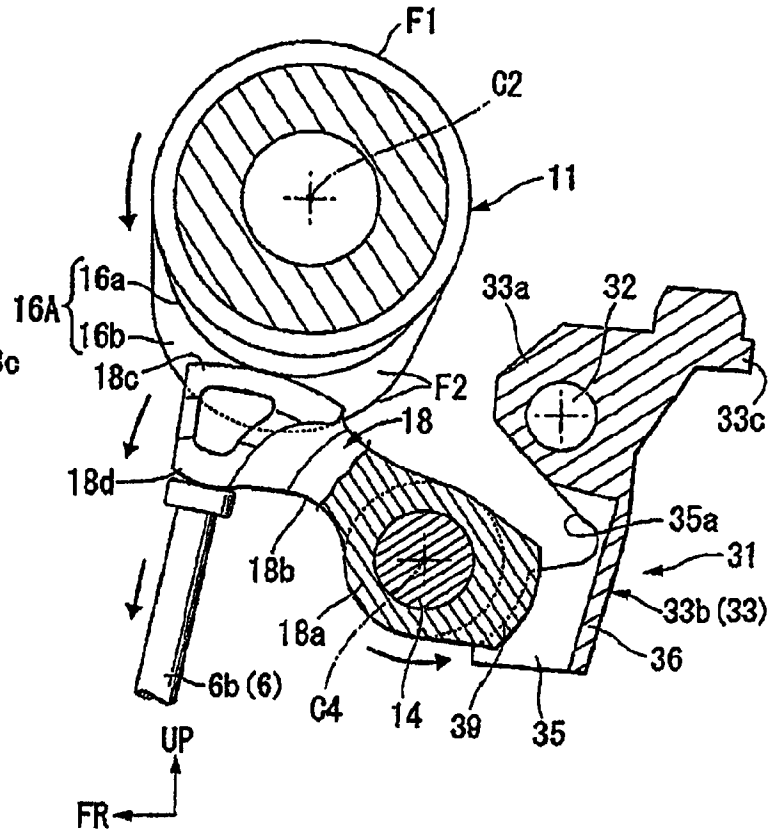
FIG. 11B is a cross-sectional view showing the second operation, and corresponding to FIG. 4B.
Figure 11A:
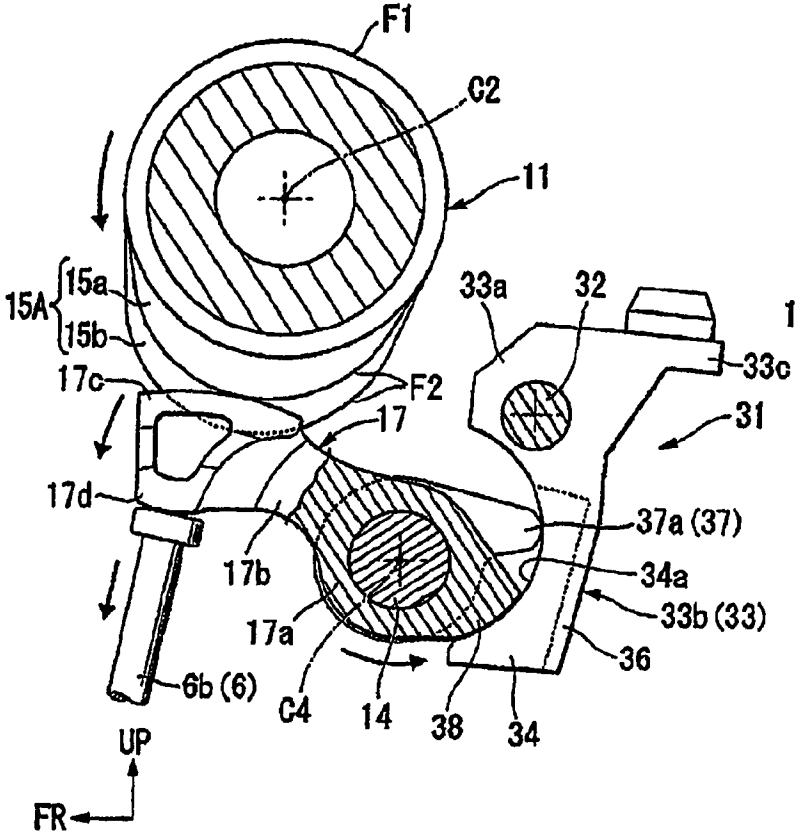
FIG. 11A is a cross-sectional view showing a second operation of the variable valve-actuating mechanism, and corresponding to FIG. 4A.

Now, the left and right rocker arms 17 and 18 are located at the first operating position, the rocker arm shaft 14 is located at the rightward-movement limit position, and the trigger arm 33 is in the first swing state. In this case, as shown in FIG. 11, in accordance with the rotational movement of the intake-side cam shaft 11, the left and right first cams 15*a* and 16*a* swing the left and right rocker arms 17 and 18 from the valve-closing side to the valve-opening side (the left and right first cams 15*a* and 16*a* press, and thereby lift, the left and right intake valves 6).

As a result, during a predetermined valve operation period including the time when the left and right intake valves 6 are lifted to the maximum extent, the overlap area as viewed in the axial directions between the lower portion of the left rocker-side key portion 38 and the lower portion of the left trigger-side key portion 34 decreases to zero (the abutting area in the axial directions is eliminated). Accordingly, the restriction against the rightward movement of the left and right rocker arms 17 and 18 with respect to the cylinder head 2 at this position is canceled.

It may be noted that when the trigger arm 33 is in the pre-swing state, even when the left and right rocker arms 17 and 18 swing, the overlap area of the left rocker-side key portion 38 and the left trigger-side key portion 34 does not decrease to zero. Accordingly, until the trigger arm 33 is brought into the first swing state (that is, until the first spring 23 accumulates a predetermined force), the rightward movement of the left and right rocker arms 17 and 18 remains restricted.

On the other hand, the rear portion of the right rocker-side key portion 39 and the lower portion of the right trigger-side key portion 35 are arranged coaxially with the rocker arm shaft 14. For this reason, the overlap area of the rear portion of the right rocker-side key portion 39 and the lower portion of the right trigger-side key portion 35 hardly changes, e.g., does not increase or decrease, even when the left and right rocker arms 17 and 18 swing.

Figure 12B:
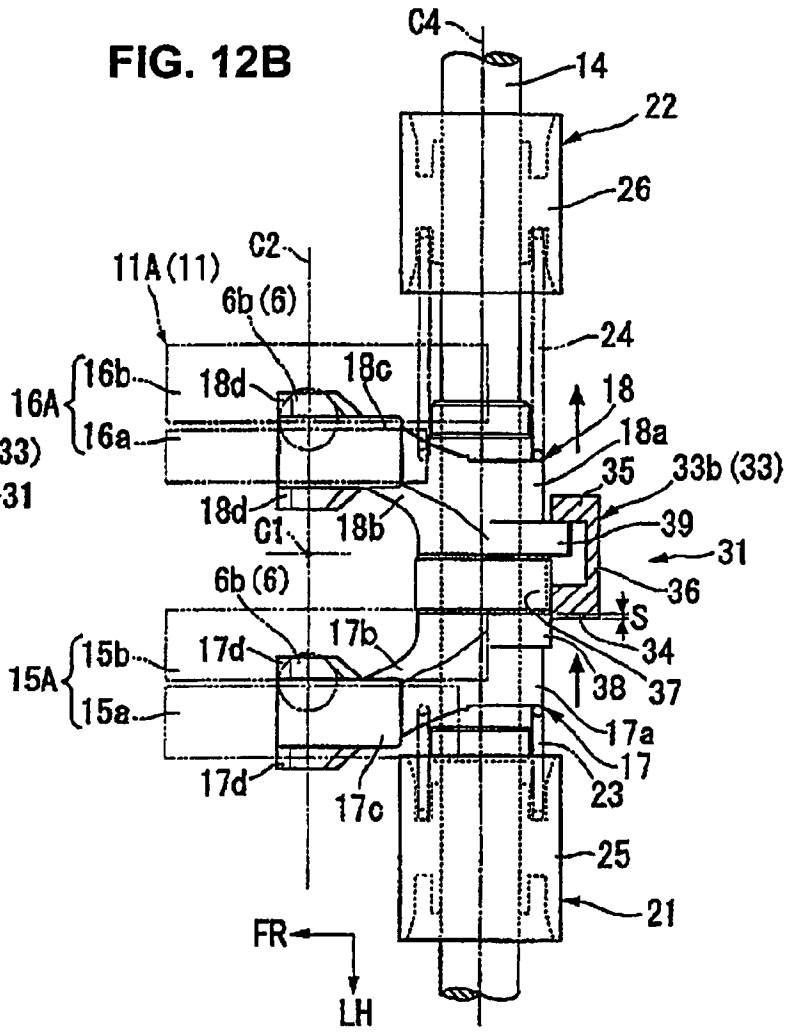
FIG. 12B is a top view showing a third operation of the variable valve-actuating mechanism, and corresponding to FIG. 2.
Figure 12A:
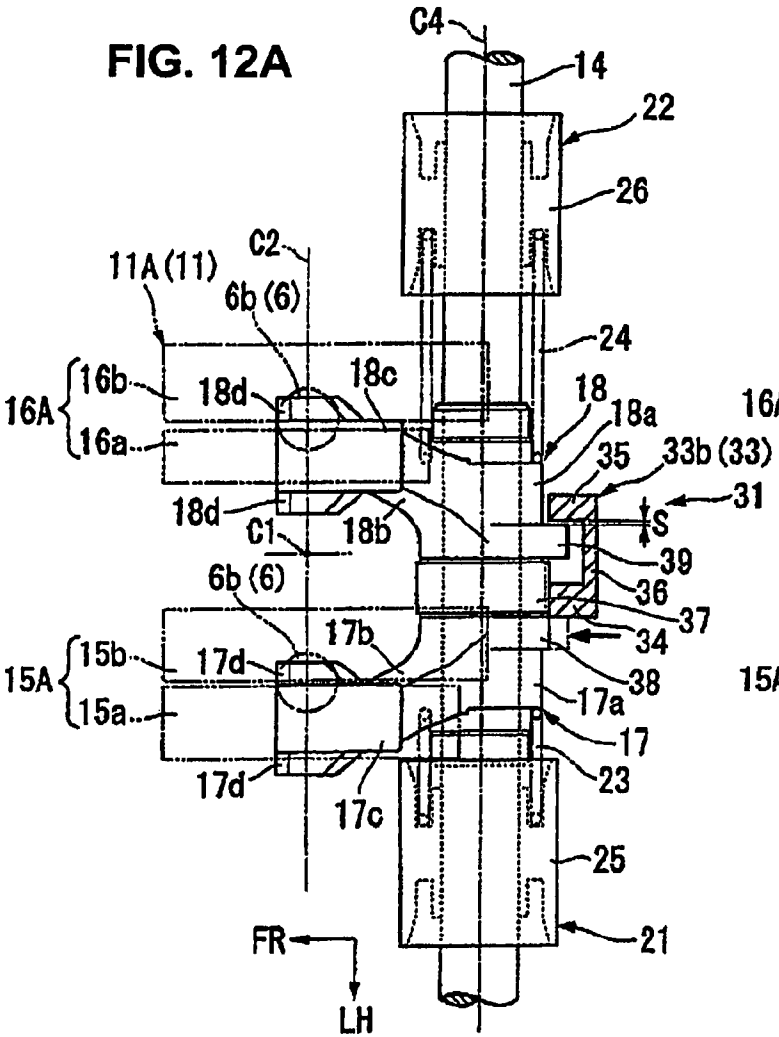
FIG. 12A is a top view showing the second operation of the variable valve-actuating mechanism, and corresponding to FIG. 2.

Accordingly, as shown in FIG. 12, when the restriction against the rightward movement of the left and right rocker arms 17 and 18 between the left rocker-side key portion 38 and the left trigger-side key portion 34 is canceled, as discussed above, the left and right rocker arms 17 and 18 (and also the center collar 37) are moved rightwardly by a distance equivalent to the space S between the right rocker-side key portion 39 and the right trigger-side key portion 35.

At this time, the rear portion of the rocker-side key portion 39 and the lower portion of the right trigger-side key portion 35 abut on each other in the axial directions. Accordingly, the rightward movement of the left and right rocker arms 17 and 18 with respect to the cylinder head 2 is restricted. In addition, at this time, the lower portion of the left rocker-side key portion 38 and the lower portion of the left trigger-side key portion 34 overlap in the axial directions by the amount equivalent to the space S.

Figure 13B:
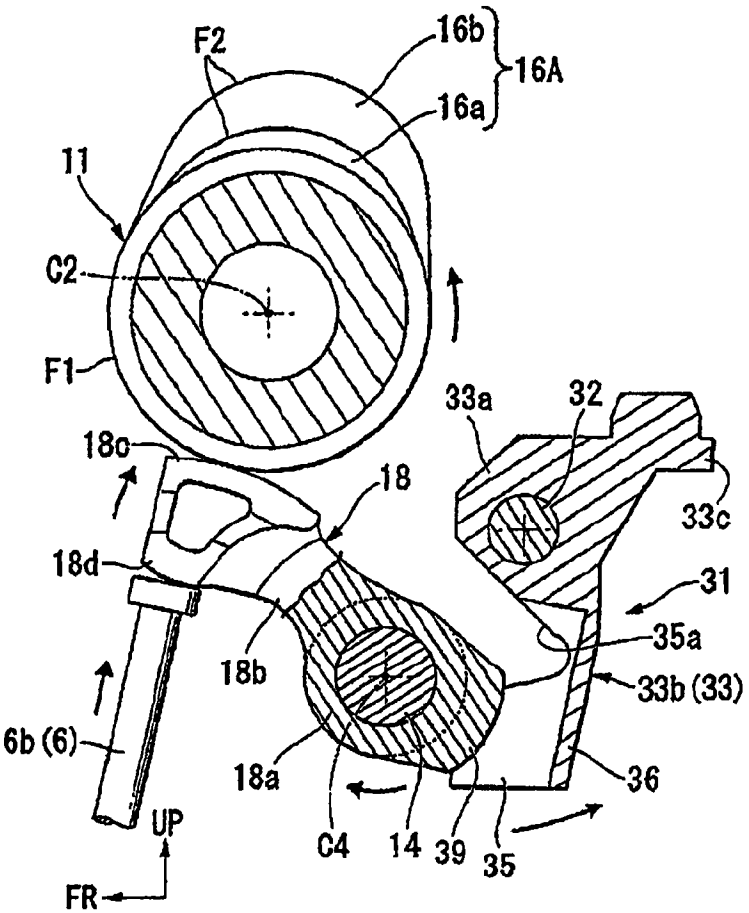
FIG. 13B is a cross-sectional view showing the fourth operation, and corresponding to FIG. 4B.
Figure 13A:
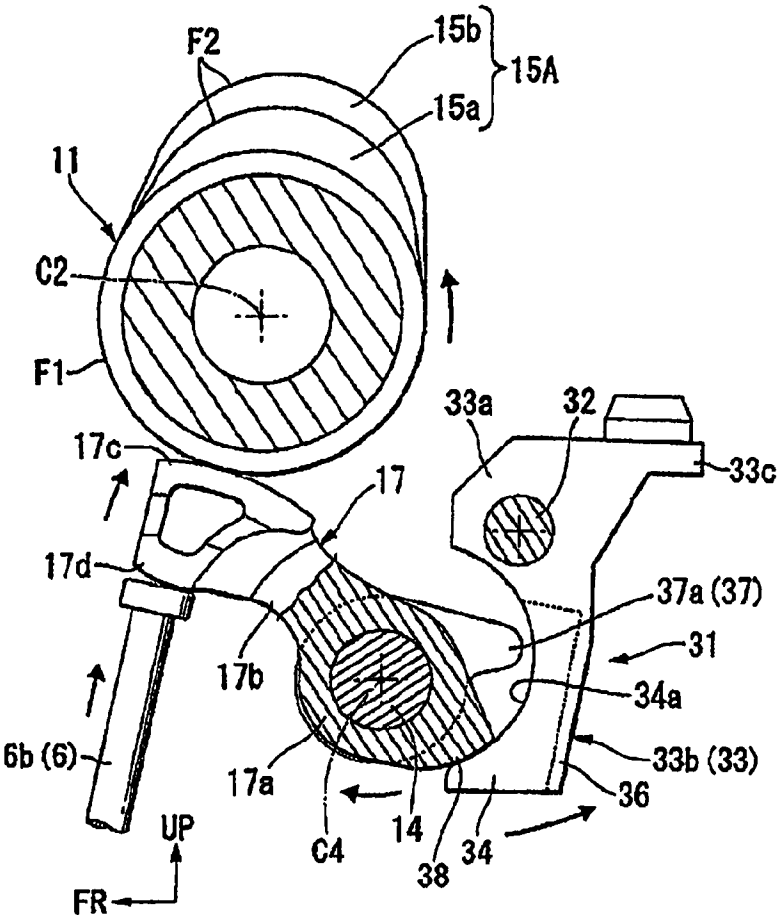
FIG. 13A is a cross-sectional view showing a fourth operation of the variable valve-actuating mechanism, and corresponding to FIG. 4A.

When the left rocker-side key portion 38 and the left trigger-side key portion 34 overlap in the axial directions by the predetermined amount, as discussed above, the intake-side cam shaft 11 is continuously driven to rotate, so that the left and right rocker arms 17 and 18 swing from the valve-opening side to the valve-closing side. During such operation, as shown in FIG. 13, the outer peripheral surface of the lower portion of the left rocker-side key portion 38 is brought into sliding contact with the inner peripheral surface of the lower portion of the cutout portion 34*a* of the left trigger-side key portion 34. Accordingly, the trigger arm 33 is caused to further rotate from the first swing state in the counterclockwise direction (FIG. 13).

Figure 14B:
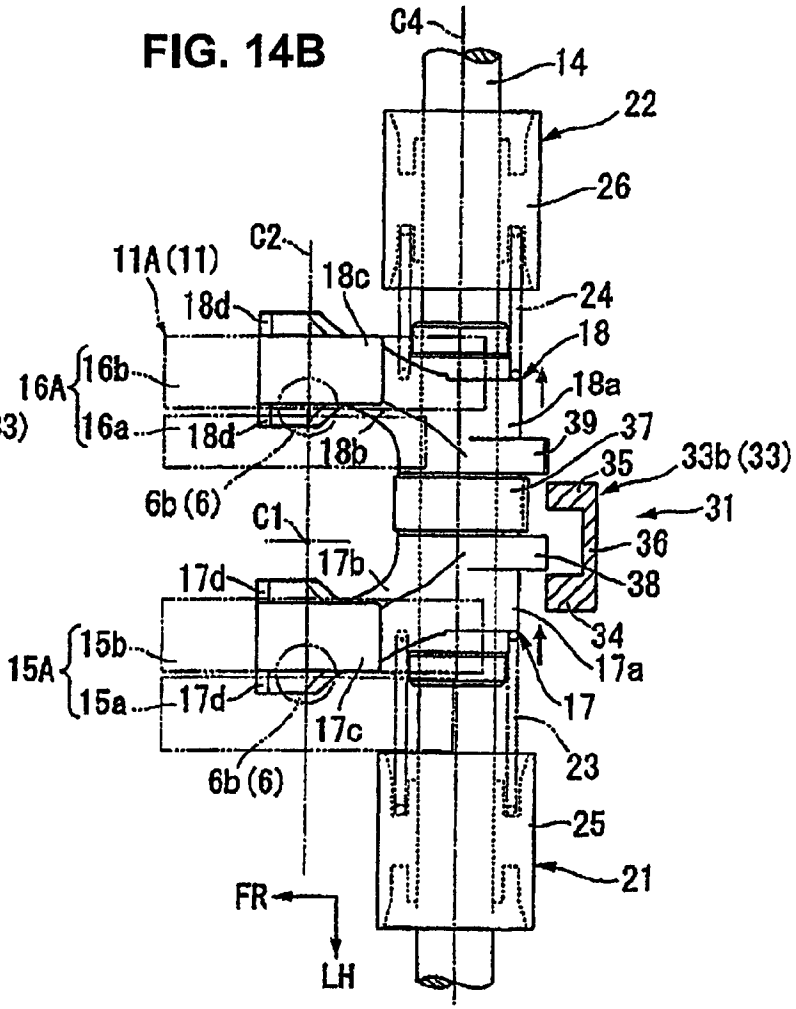
FIG. 14B is a top view showing a fifth operation of the variable valve-actuating mechanism, and corresponding to FIG. 2.
Figure 14A:
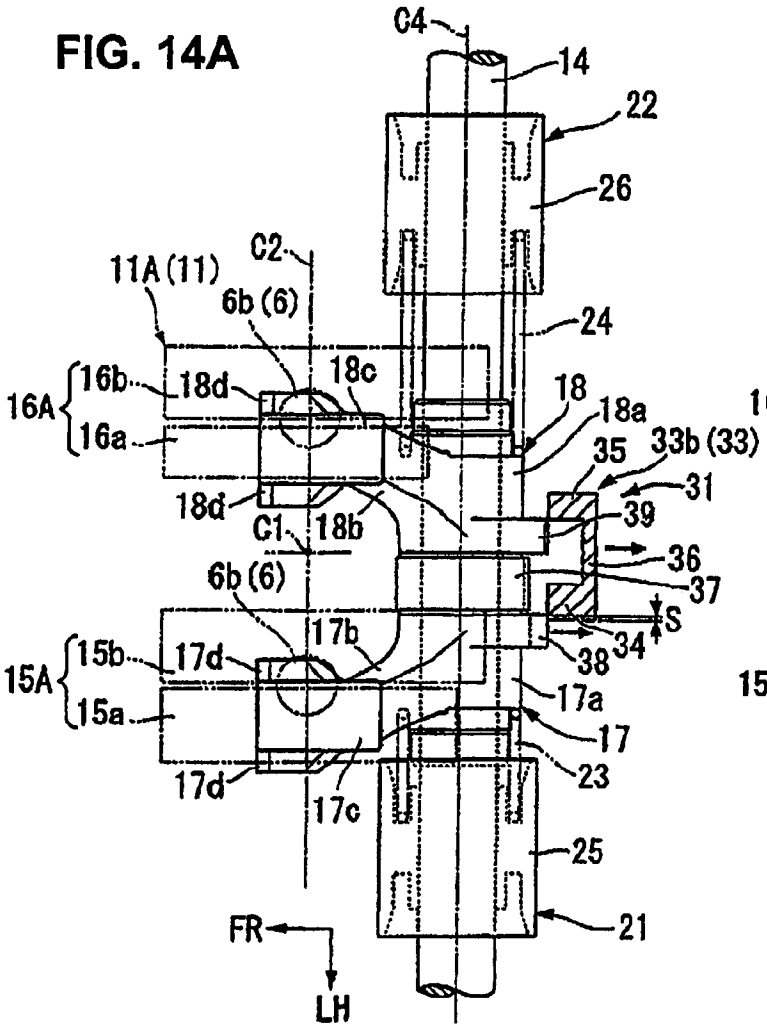
FIG. 14A is a top view showing the fourth operation of the variable valve-actuating mechanism, and corresponding to FIG. 2.

Further, as shown in FIG. 14, when the left and right rocker arms 17 and 18 swing, so that the lift amount of the intake valves 6 decreases to zero (the intake valves 6 fall into a valve-fully-opening state), the overlap area of the rear portion of the right rocker-side key portion 39 and the lower portion of the right trigger-side key portion 35 (as viewed in the axial directions) decreases to zero (i.e., the abutting area in the axial directions is eliminated). The restriction against the rightward movement of the left and right rocker arms 17 and 18 with respect to the cylinder head 2 is thus canceled.

At this time, the restriction against the movement of the left and right rocker arms 17 and 18 between the left rocker-side key portion 38 and the left trigger-side key portion 34 has also been canceled. The left and right rocker arms 17 and 18 (and also the center collar 37) are therefore allowed to be moved rightward. Accordingly, the left and right rocker arms 17 and 18 are moved to the second operating position by the elastic force accumulated in the first spring 23.

When the movement of the left and right rocker arms 17 and 18 to the second operating position is completed, the left and right rocker-side key portions 38 and 39 do not overlap, in the axial directions, the left and right trigger-side key portions 34 and 35, respectively. As a result, the trigger arm 33 rotates by the biasing force of the spring 33*d* in the clockwise direction as viewed in FIG. 13 or the like, so as to return to the pre-swing state.

Figure 15:
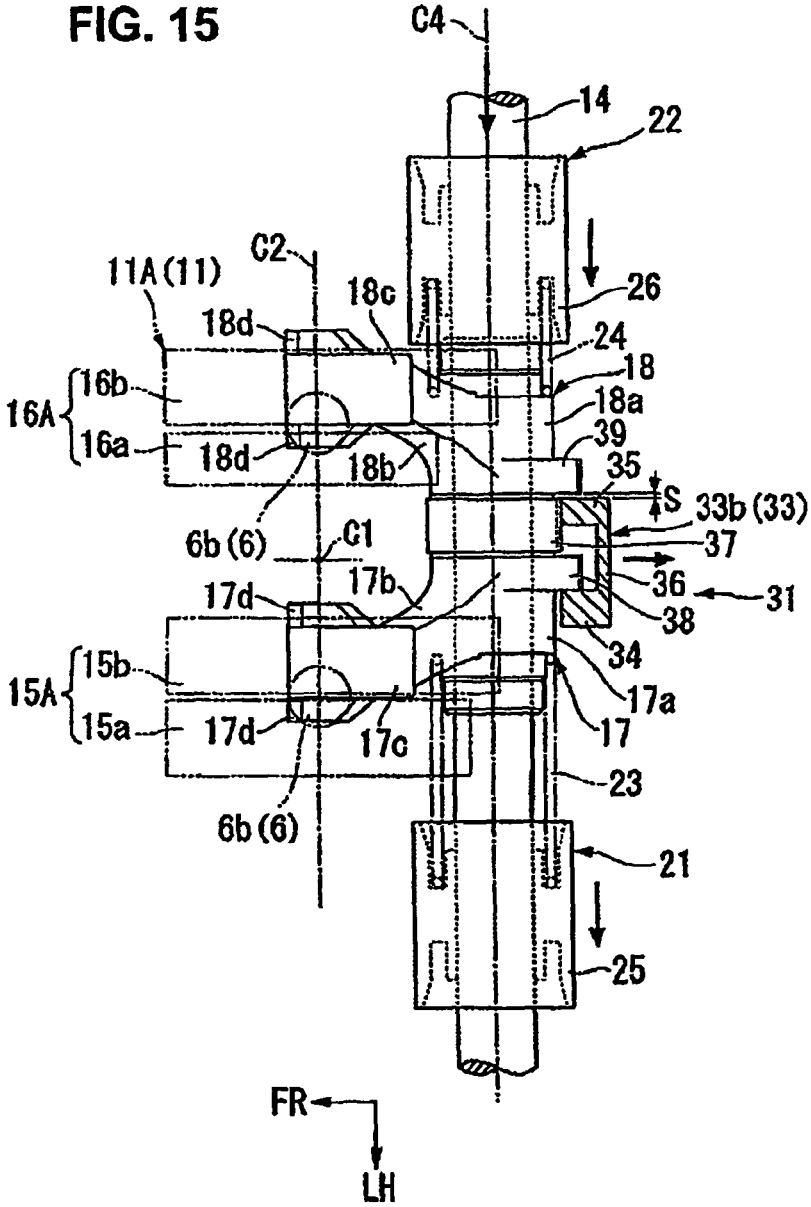
FIG. 15 is a top view showing a sixth operation of the variable valve-actuating mechanism, and corresponding to FIG. 3.

Next, when the left and right rocker arms 17 and 18 are located at the second operating position, a predetermined force is accumulated in the second rocker-arm moving mechanism 22 in order to move the left and right rocker arms 17 and 18 to the first operating position. Firstly, as shown in FIG. 15, the shaft driving mechanism 41 is activated, so that the rocker arm shaft 14, located at the rightward-movement limit position, is moved leftward along with the spring receiving collars 25 and 26.

At this time, the lower portion of the left rocker-side key portion 38 of the left rocker arm 17 and the lower portion of the left trigger-side key portion 34 of the trigger arm 33 overlap to the predetermined extent when viewed in the axial directions. Accordingly, the lower portion of the left rocker-side key portion 38 and the lower portion of the left trigger-side key portion 34 abut on each other in the axial directions, so that the leftward movement of the left and right rocker arms 17 and 18 with respect to the trigger arm 33 (the cylinder head 2) is restricted at this position.

At this time, the rear portion of the right rocker-side key portion 39 of the right rocker arm 18 and the lower portion of the right trigger-side key portion 35 of the trigger arm 33 also overlap to the predetermined extent when viewed in the axial directions. The space S is secured between the rear portion of the right rocker-side key portion 39 and the right trigger-side key portion 35.

Figure 16B:
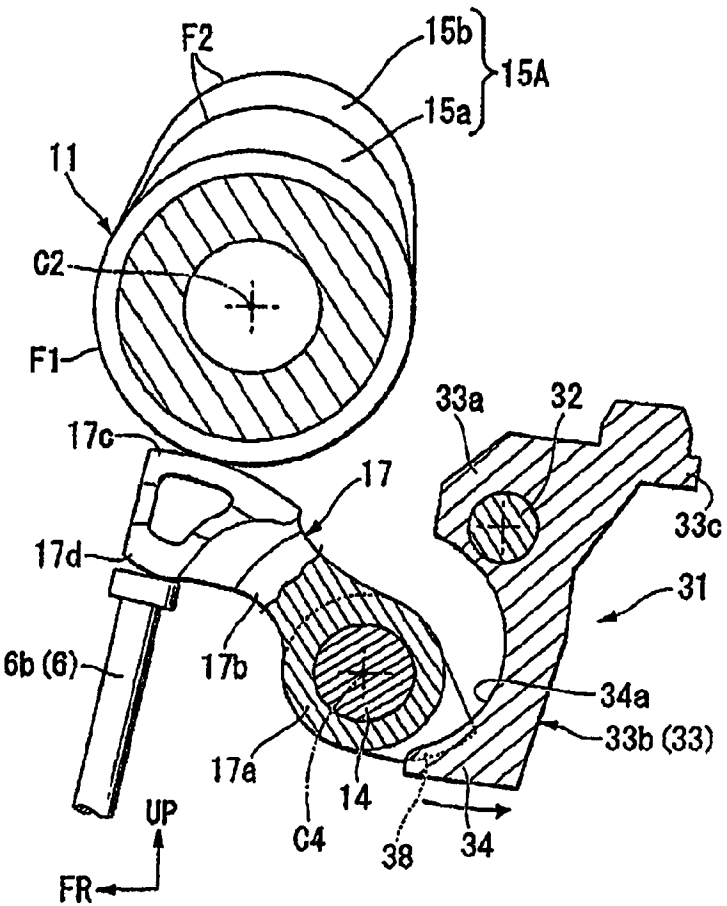
FIG. 16B is a cross-sectional view showing the sixth operation, and corresponding to FIG. 5B.
Figure 16A:
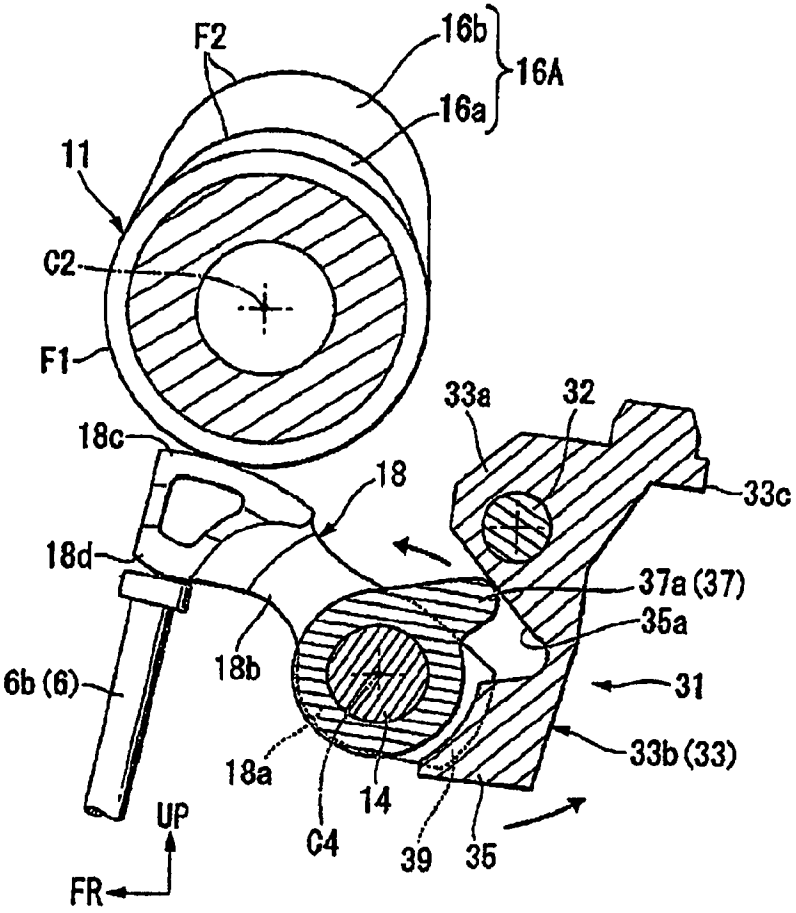
FIG. 16A is a cross-sectional view showing the sixth operation of the variable valve-actuating mechanism, and corresponding to FIG. 5A.

As shown in FIG. 16, along with the leftward movement, the rocker arm shaft 14 rotates in the counterclockwise direction about the axis thereof. The center collar 37 rotates in the counterclockwise direction along with the rotation of the rocker arm shaft 14. Accordingly, the outer peripheral surface of the tip portion of the center cam portion 37*a* is brought into sliding contact with the inner peripheral surface of the upper portion of the cutout portion 35*a* of the right trigger-side key portion 35 of the trigger arm 33 in the pre-swing state. As a result, the trigger arm 33 is caused to rotate in the counterclockwise direction against the biasing force of the spring 33*d*.

Subsequently, when the rocker arm shaft 14 is moved to the leftward-movement limit position, the rotation of the center collar 37, which is associated with the movement of the rocker arm shaft 14, is terminated, and also the rotation of the trigger arm 33, which is associated with the rotation of the center collar 37, is terminated. At this moment, the lower portion of the left rocker-side key portion 38 and the lower portion of the left trigger-side key portion 34 still overlap although the overlap area (as viewed in the axial directions) is reduced.

Concurrently, the rear portion of the right rocker-side key portion 39 and the lower portion of the right trigger-side key portion 35 also still overlap although the overlap area (as viewed in the axial directions) is reduced. At this time, the lower portion of the cutout portion 35*a* of the right trigger-side key portion 35 has an arch shape which is substantially coaxial with the rocker arm shaft 14 as viewed in the axial directions. As a result, the trigger arm 33 falls into the first swing state.

As discussed above, when the rocker arm shaft 14, and the spring receiving collars 25, 26, are moved from the rightward movement limit position to the leftward movement limit position, the second spring 24 (located between the second spring receiving collar 26 and the base portion 18*a* of the right rocker arm 18 whose movement is restricted) is compressed by a predetermined amount of elastic force. The second spring 24 is thus brought into a state in which the second spring 24 has accumulated an elastic force capable of moving the left and right rocker arms 17 and 18 from the second operating position to the first operating position.

Figure 17B:
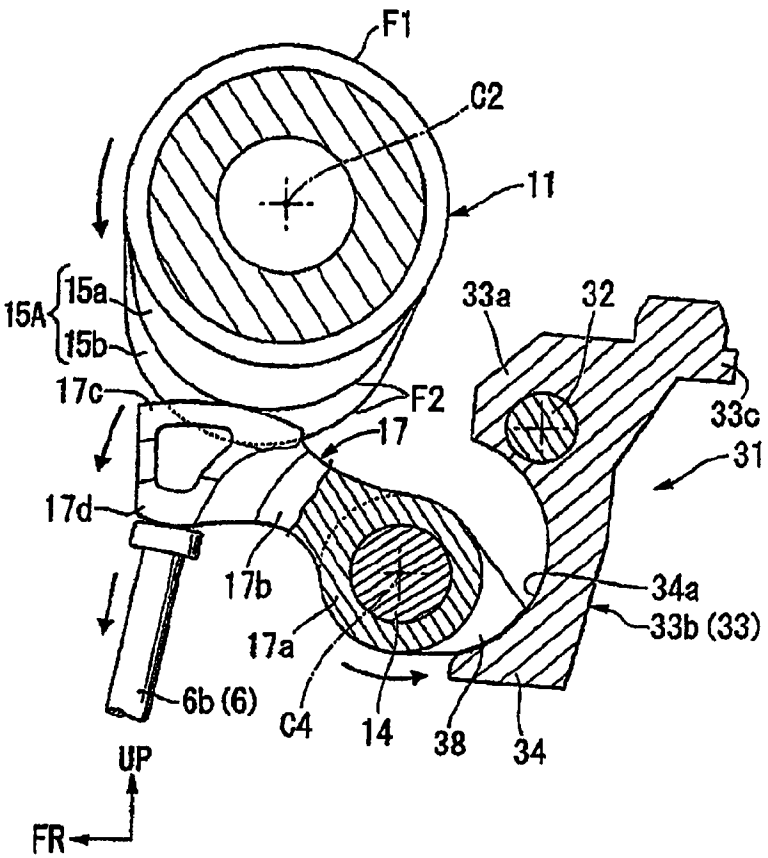
FIG. 17B is a cross-sectional view showing the seventh operation, and corresponding to FIG. 5B.
Figure 17A:
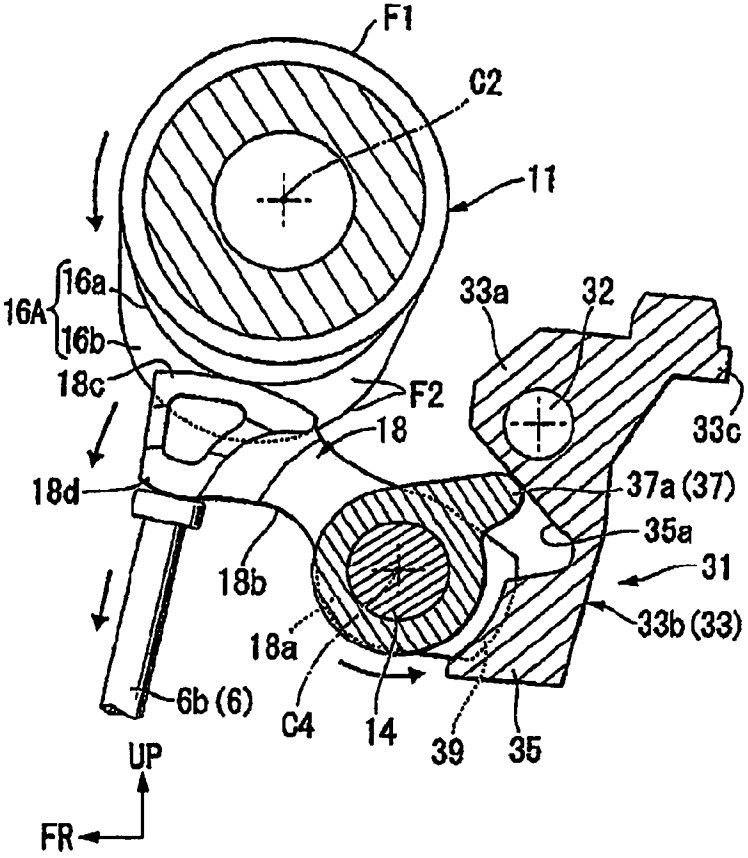
FIG. 17A is a cross-sectional view showing a seventh operation of the variable valve-actuating mechanism, and corresponding to FIG. 5A.

Now, the left and right rocker arms 17 and 18 are located at the second operating position, the rocker arm shaft 14 is located at the leftward movement limit position, and the trigger arm 33 is in the first swing state. In this case, as shown in FIG. 17, in accordance with the rotational movement of the intake-side cam shaft 11, the left and right second cams 15*b* and 16*b* swing the left and right rocker arms 17 and 18 from the valve-closing side to the valve-opening side.

In this event, for example, during a predetermined valve operation period including the time when the left and right intake valves 6 are lifted to the maximum extent, the overlap area as viewed in the axial directions between the lower portion of the left rocker-side key portion 38 and the lower portion of the left trigger-side key portion 34 decreases to zero. Accordingly, the restriction against the leftward movement of the left and right rocker arms 17 and 18 with respect to the cylinder head 2 at this position is canceled.

It may be note that when the trigger arm 33 is in the pre-swing state, even when the left and right rocker arms 17 and 18 swing, the overlap area of the left rocker-side key portion 38 and the left trigger-side key portion 34 does not decrease to zero. Accordingly, until the trigger arm 33 is brought into the first swing state (that is, until the second spring 24 accumulates a predetermined force), the leftward movement of the left and right rocker arms 17 and 18 remains restricted.

Figure 18B:
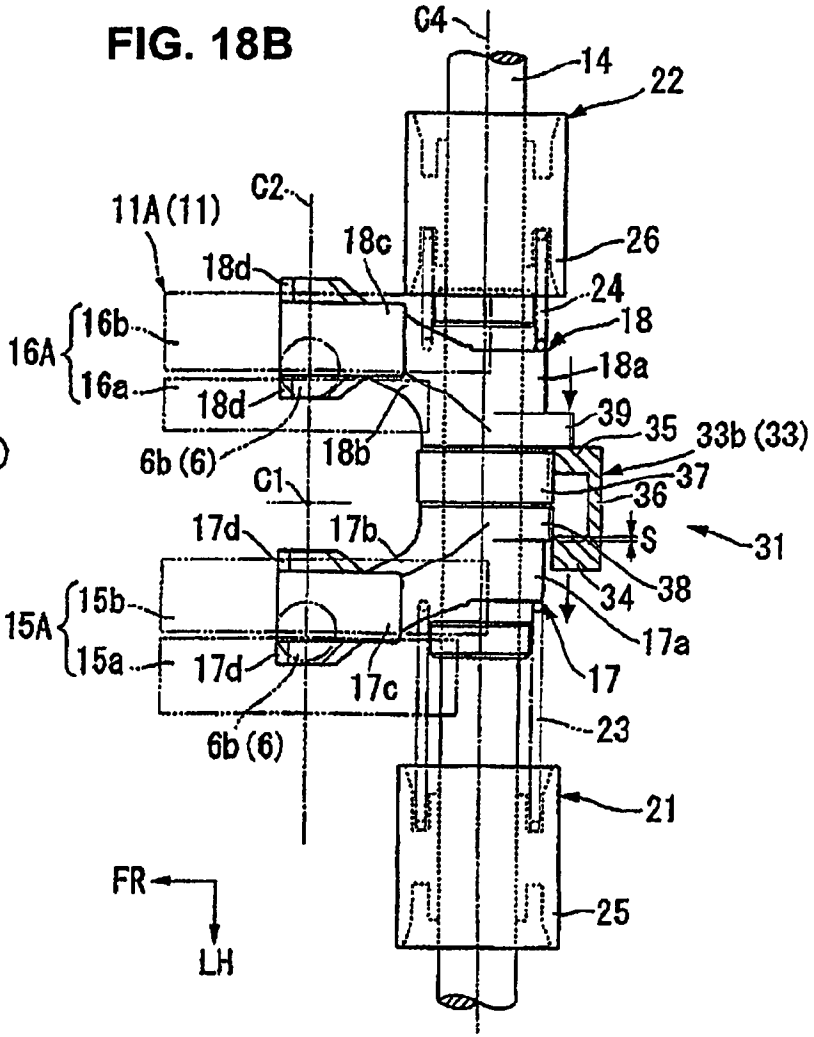
FIG. 18B is a top view showing an eighth operation of the variable valve-actuating mechanism, and corresponding to FIG. 3.
Figure 18A:
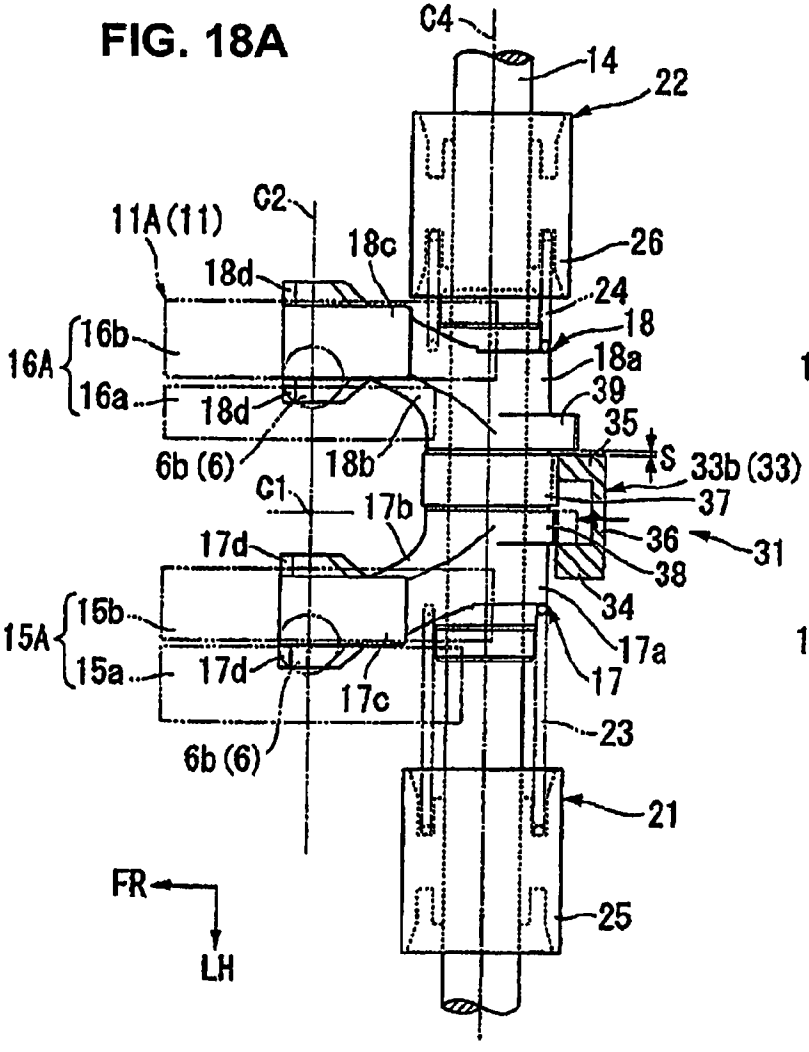
FIG. 18A is a top view showing the seventh operation of the variable valve-actuating mechanism, and corresponding to FIG. 3.

On the other hand, the overlap area of the rear portion of the right rocker-side key portion 39 and the lower portion of the right trigger-side key portion 35 hardly changed, i.e. does not increase or decrease, even when the left and right rocker arms 17 and 18 swing. Accordingly, as shown in FIG. 18, when the restriction against the leftward movement of the left and right rocker arms 17 and 18 between the left rocker-side key portion 38 and the left trigger-side key portion 34 is canceled, and as discussed above, the left and right rocker arms 17 and 18 are moved leftward by the amount equivalent to the space S.

At this time, the rear portion of the right rocker-side key portion 39 and the lower portion of the right trigger-side key portion 35 abut on each other in the axial directions. Accordingly, the leftward movement of the left and right rocker arms 17 and 18 with respect to the cylinder head 2 is restricted. At this time, the lower portion of the left rocker-side key portion 38 and the lower portion of the left trigger-side key portion 34 overlap in the axial directions by the amount equivalent to the space S.

Figure 19B:
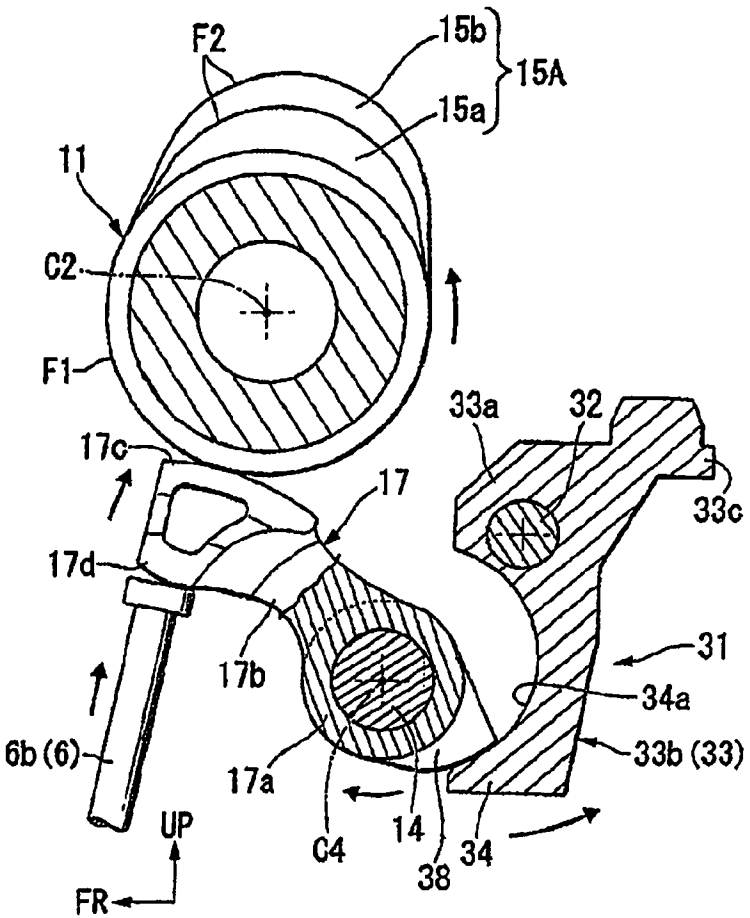
FIG. 19B is a cross-sectional view showing the ninth operation, and corresponding to FIG. 5B.
Figure 19A:
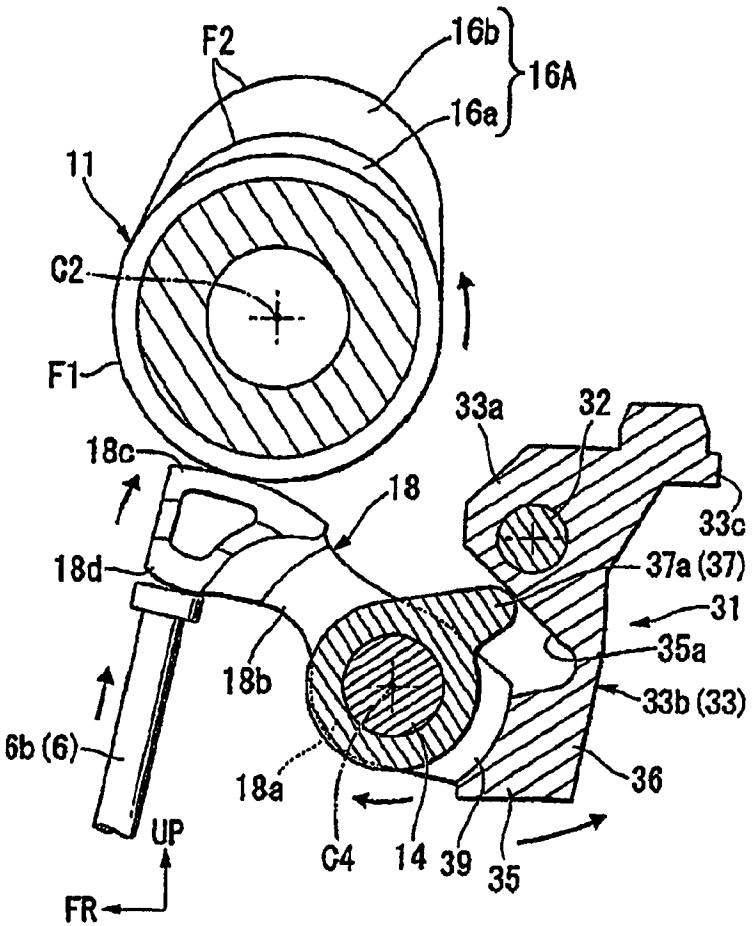
FIG. 19A is a cross-sectional view showing a ninth operation of the variable valve-actuating mechanism, and corresponding to FIG. 5A.

When the left rocker-side key portion 38 and the left trigger-side key portion 34 overlap in the axial directions by the predetermined amount, as discussed above, the intake-side cam shaft 11 is continuously driven to rotate, so that the left and right rocker arms 17 and 18 swing from the valve-opening side to the valve-closing side. Therefore, as shown in FIG. 19, the outer peripheral surface of the lower portion of the left rocker-side key portion 38 is brought into sliding contact with the inner peripheral surface of the lower portion of the cutout portion 34*a* of the left trigger-side key portion 34. Accordingly, the trigger arm 33 is caused to further rotate from the first swing state in the counterclockwise direction as viewed in FIG. 19 and the corresponding figures.

Figure 20B:
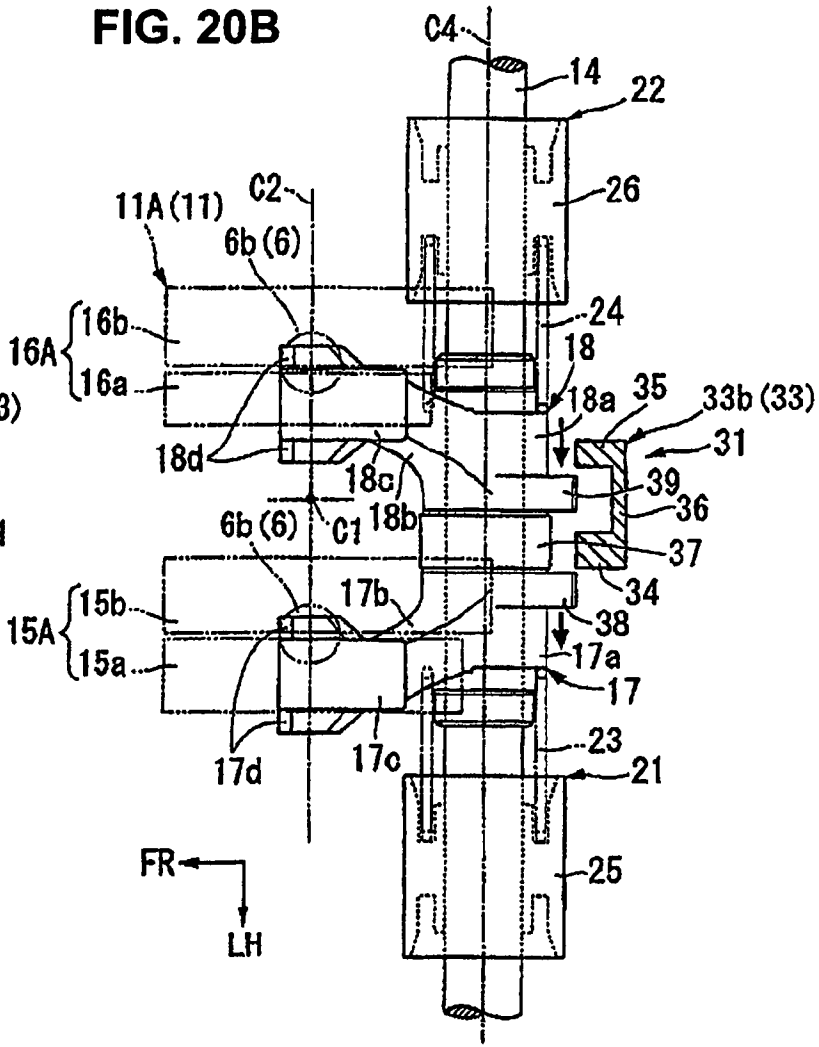
FIG. 20B is a top view showing a tenth operation of the variable valve-actuating mechanism, and corresponding to FIG. 3.
Figure 20A:
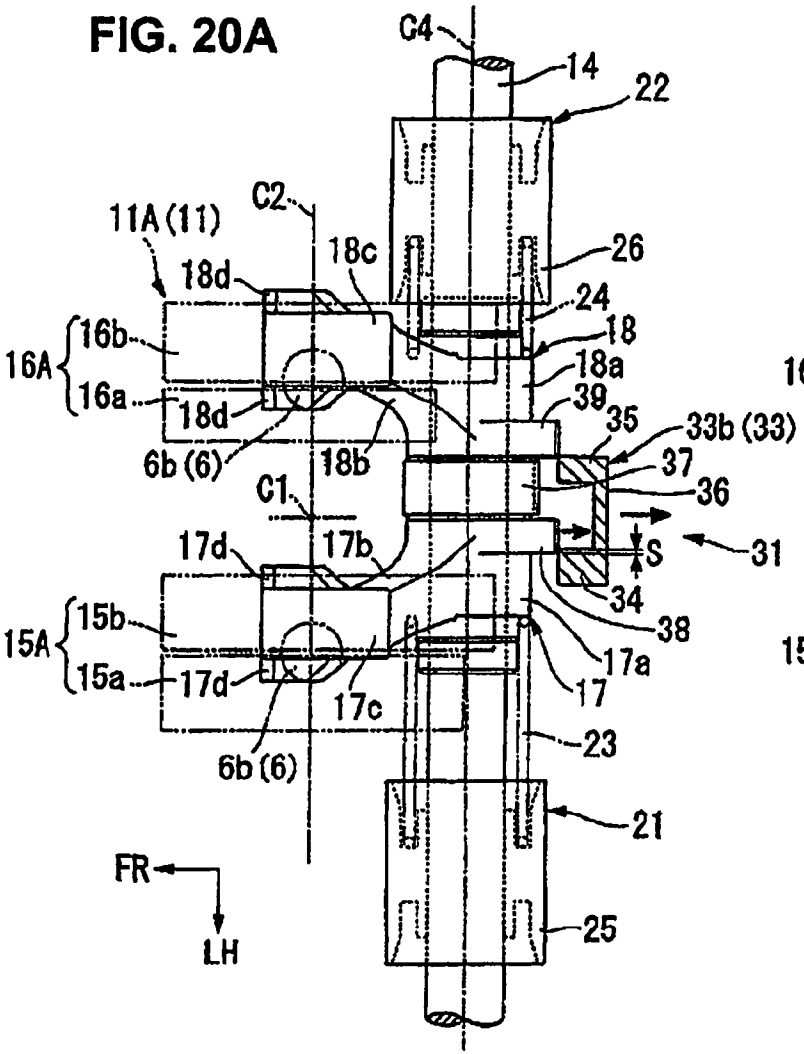
FIG. 20A is a top view showing the ninth operation of the variable valve-actuating mechanism, and corresponding to FIG. 3.

As shown in FIG. 20, when the left and right rocker arms 17 and 18 swing, so that the lift amount of the intake valves 6 decreases to zero, the overlap area of the rear portion of the right rocker-side key portion 39 and the lower portion of the right trigger-side key portion 35 in the axial directions decreases to zero. The restriction against the leftward movement of the left and right rocker arms 17 and 18 with respect to the cylinder head 2 is thus canceled.

Further, at this time, the restriction against the movement of the left and right rocker arms 17 and 18 between the left rocker-side key portion 38 and the left trigger-side key portion 34 is canceled. The left and right rocker arms 17 and 18 (and also the center collar 37) are therefore allowed to move leftward. Accordingly, the left and right rocker arms 17 and 18 are moved to the first operating position by the elastic force accumulated in the second spring 24.

When the movement of the left and right rocker arms 17 and 18 to the first operating position is completed, the left and right rocker-side key portions 38 and 39 do not overlap, in the axial directions, the left and right trigger-side key portions 34 and 35, respectively. As a result, the trigger arm 33 rotates by the biasing force of the spring 33*d* in the clockwise direction (FIG. 19) so as to return to the pre-swing state.

As discussed above, the opening and closing timings as well as the lift amount of the intake valves 6 are appropriately varied (are made variable) according to engine speed, i.e., between the engine speed of the engine 1 (the rotational speed of the crankshaft) is zero and in the low speed range, and when the engine speed is in the high speed range. This makes it possible to decrease the valve overlap and suppress the lift amount, in the low speed range of the engine 1, and also to increase the valve overlap and increase the lift amount, in the high speed range of the engine 1.

In an embodiment of the present invention, a variable valve-actuating mechanism (similar to the one described above) may be configured in the exhaust side of the engine 1. In such configuration, more effective intake and exhaust operations may be achieved in every speed range of the engine 1.

Figure 21:
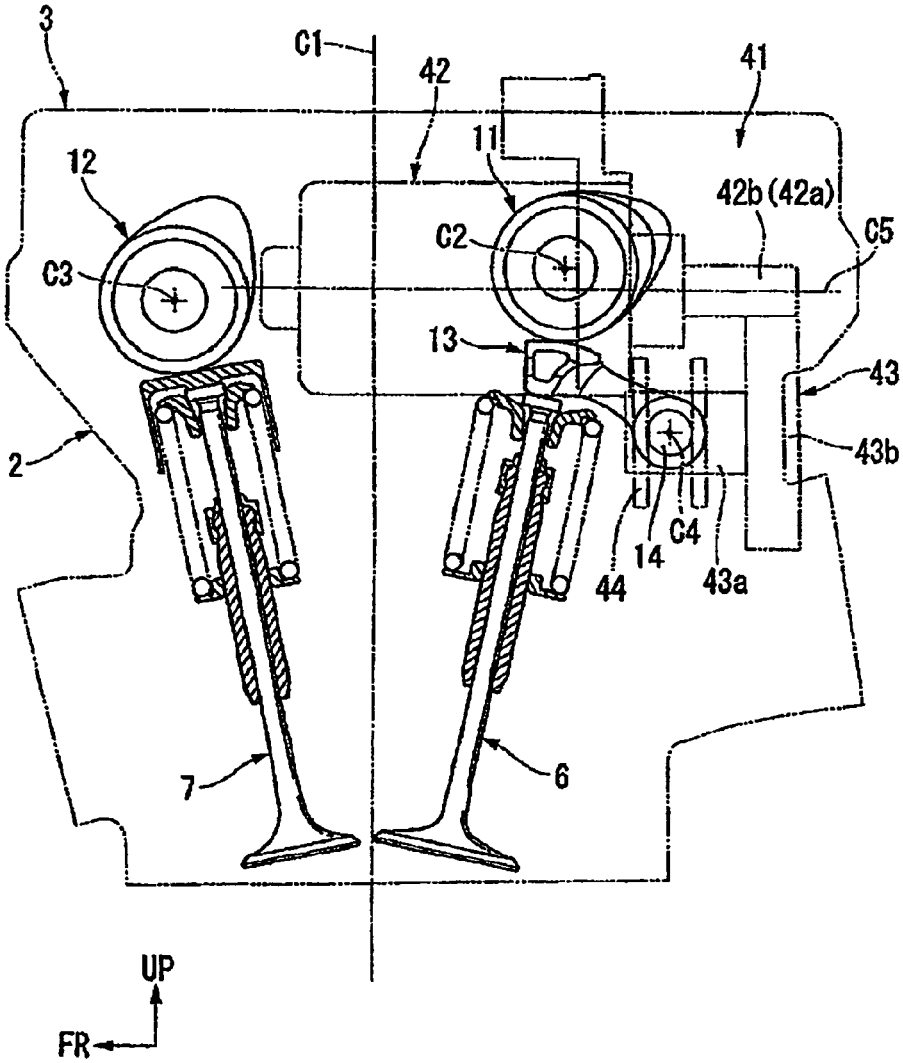
FIG. 21 is a left-side view showing a shaft driving mechanism of the variable valve-actuating mechanism, and corresponding to FIG. 1.
Figure 22:
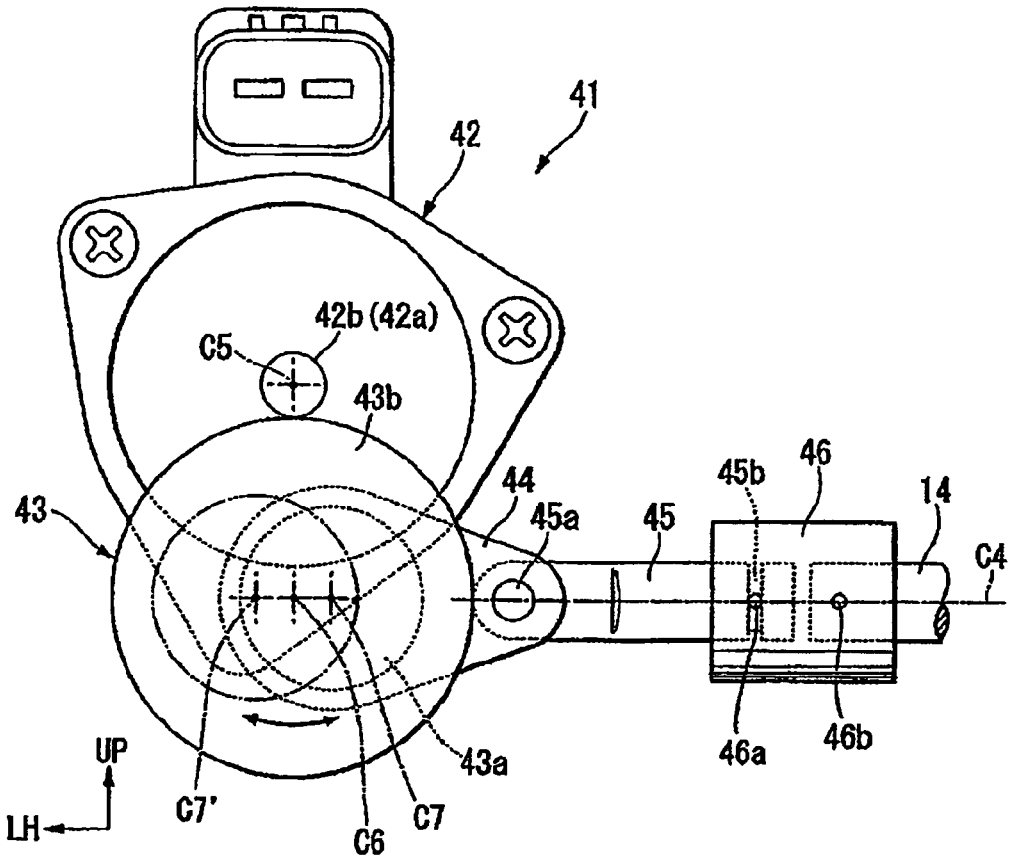
FIG. 22 is a rear view showing a main part of the shaft driving mechanism.

As shown in FIGS. 21 and 22, the shaft driving mechanism 41 includes an electric motor 42, a reduction gear shaft 43, and a connecting rod 44. The electric motor 42 serves as a drive source for the shaft driving mechanism 41. The reduction gear shaft 43 is arranged in parallel with a drive shaft 42*a* of the electric motor 42. The connecting rod 44 connects an eccentric shaft 43*a* of the reduction gear shaft 43 with an end of the rocker arm shaft 14.

The electric motor 42 is installed in the left (or the right) side of the cylinder head 2, and disposed in such a manner that the drive axis C5 of the motor 42 is perpendicular to the cylinder axis C1 when viewed in a side view. A drive gear 42*b* is formed on the outer periphery of the drive shaft 42*a* of the electric motor 42. The drive gear 42*b* engages with a large-diameter gear 43*b* on an end side of the reduction gear shaft 43. The rotational driving force of the electric motor 42 is reduced by these gears 42*b* and 43*b* to be transmitted to the reduction gear shaft 43.

By displacing the eccentric shaft 43*a* of the reduction gear shaft 43 to the left and to the right, the rocker arm shaft 14 is reciprocated in the left and right directions (in the axial directions). Accordingly, the elastic force is accumulated in the first rocker-arm moving mechanism 21 or the second rocker-arm moving mechanism 22.

In the FIG. 22, a rotational center line of the reduction gear shaft 43 is denoted reference numeral C6, a center axis of the eccentric shaft 43*a* at the time when the rocker arm shaft 14 is moved to the right is denoted by a reference numeral C7, and a center axis of the eccentric shaft 43*a* at the time when the rocker arm shaft 14 is moved to the left is denoted by a reference numeral C7.

Figure 23:
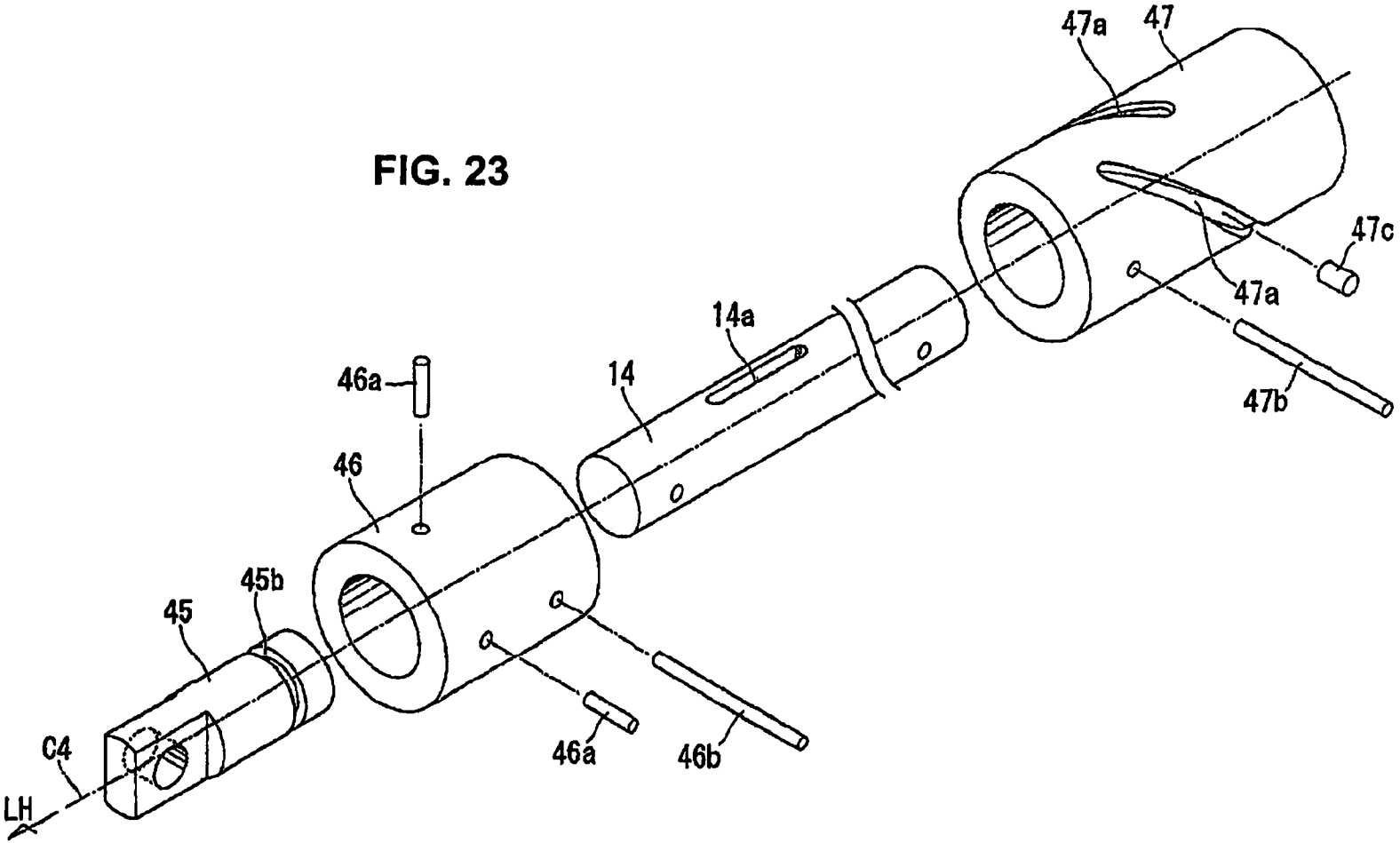
FIG. 23 is an exploded perspective view showing the rocker arm shaft.

As shown in FIG. 23, an end rod 45 having the same axis as that of the rocker arm shaft 14 is attached to a first end portion of the rocker arm shaft 14 with an end collar 46 disposed therebetween. The end rod 45 is pivotally connected at an end portion thereof with the tip portion of the connecting rod 44 with a connecting pin 45*a* which is provided in parallel with the eccentric shaft 43*a*. The end rod 45 is held at the other end portion thereof by the end collar 46, so as not to be movable in the axial directions of the end rod 45, and concurrently to be rotatable about the axis thereof.

The end collar 46 holds the end rod 45 by using multiple engagement pins 46*a* in such a manner that the end rod 45 can rotate about the axis of the end rod 45. On the other hand, the first end portion of the rocker arm shaft 14 is fixedly held by the end collar 46 by using a connecting pin 46*b* penetrating the rocker arm shaft 14 and the end collar 46 in the radial direction thereof.

The engagement pins 46*a*, protruding from the inner periphery of the end collar 46, engage with an engagement groove 45*b* formed in the outer periphery of the end rod 45. Moreover, the left end portion of the first spring 23 is fitted into the inner periphery, on the right side, of the end collar 46, in the same manner as that of the first spring receiving collar 25. In other words, the end collar 46 also functions as the first spring receiving collar 25 in the cylinder, on the outer left side, of the engine 1.

The rocker arm shaft 14 is formed of a single piece extending over the cylinders of the engine 1. A collar 47 is fixedly attached to a second end portion of the rocker arm shaft 14 by using a connecting pin 47*b* penetrating the rocker arm shaft 14 and the collar 47 for rotation in the radial direction thereof. A helical engagement groove 47*a* is formed in the outer periphery of the collar 47 for rotation.

The collar 47 for rotation is inserted into and supported in an support hole (not shown) provided in the cylinder head 2 so as to be rotatable about the axis of the collar 47, and concurrently to be movable in the axial directions thereof. An engagement pin 47*c* protruding from the inner periphery of the support hole engages appropriately with the engagement groove 47*a* of the collar 47 for rotation. With this configuration, when the rocker arm shaft 14 is moved, the end collar 46, the rocker arm shaft 14, the collar 47, the first spring receiving collar 25, and the second spring receiving collar 26 are rotated as appropriate in accordance with the movement.

The right end portion of the second spring 24 is fitted into the inner periphery, on the left side, of the collar 47 for rotation, in the same manner as that of the second spring receiving collar 26. In other words, the collar 47 for rotation also functions as the second spring receiving collar 26 in the cylinder, on the outer right side, of the engine 1.

As have been discussed above, the valve-actuating system 5 of the engine 1 of an embodiment of the present invention includes the intake-side cam shaft 11, and the left and right rocker arms 17 and 18. The intake-side cam shaft 11 includes, for each intake valve 6, the pair of first cams 15*a* and 16*a* as well as the pair of second cams 15*b* and 16*b*. The rocker arm shaft 14 is provided in parallel with the intake-side cam shaft 11, and the left and right rocker arms 17 and 18 are supported on the rocker arm shaft 14 so as to be swingable about the axis of the rocker arm shaft 14, and concurrently to be movable in the axial directions thereof.

In accordance with the rotational movement of the intake-side cam shaft 11, each of the left and right rocker arms 17 and 18 abuts on a corresponding one of the cams 15*a*, 16*a*, 15*b*, and 16*b*, so as to be swung, thereby causing the corresponding intake valve 6 to perform the opening and closing operations. Concurrently, the left and right rocker arms 17 and 18 are moved to one of: the first operating position, where the left and right rocker arms 17 and 18 are allowed to abut respectively on the first cams 15*a* and 16*a*; and the second operating position, where the left and right rocker arms 17 and 18 are allowed to abut respectively on the second cams 15*b* and 16*b*. This movement makes it possible to selectively use one of the cams 15*a*, 16*a*, 15*b*, and 16*b*, for the opening and closing operation of the intake valve 6.

In addition, in the valve-actuating system 5, the rocker arm shaft 14 is supported by the cylinder head 2 so as to be movable in the axial directions thereof. When the left and right rocker arms 17 and 18 are about to be moved to one of the operating positions, the rocker arm shaft 14 is moved in advance to the same side as that position, and thereafter the left and right rocker arms 17 and 18 are moved to the corresponding operating position.

According to this configuration, the rocker arm shaft 14 is moved in advance to the side to which the left and right rocker arms 17 and 18 are about to be moved. Accordingly, the outer peripheral surface, on the side to which the left and right rocker arms 17 and 18 are about to be moved, of the rocker arm shaft 14 becomes virtually the same as the surface which has been just covered by the left and right rocker arms 17 and 18 by itself.

Such arrangement of the rocker arm shaft 14 and rocker arms 17, 18, prevents a foreign object from being getting attached to the surface of the rocker arm shaft 14, which would otherwise interfere with the movement of the left and right rocker arms 17 and 18 on the rocker arm shaft 14. Accordingly, the left and right rocker arms 17 and 18 can be smoothly moved.

In addition, even when a foreign object enters between the left and right rocker arms 17 and 18 and the rocker arm shaft 14, the foreign object is appropriately discharged by the relative movement of the rocker arms 17 and 18 and the rocker arm shaft 14. Accordingly, a favorable movement in the axial directions, and a favorable swing about the axis, of the left and right rocker arms 17 and 18, can be maintained. Moreover, since the destination of the movement of the left and right rocker arms 17 and 18 is the surface on which the rocker arms have been positioned so far, the thickness of the oil film on that surface has been evened. Accordingly, the left and right rocker arms 17 and 18 can be smoothly moved.

Further, the valve-actuating system 5 further includes the first rocker-arm moving mechanism 21 and the second rocker-arm moving mechanism 22. The first rocker-arm moving mechanism 21 includes the first spring 23 for applying a force to the left and right rocker arms 17 and 18 in a direction from the first operating position side to the second operating position side. The second rocker-arm moving mechanism 22 includes the second spring 24 for applying a force to the left and right rocker arms 17 and 18 in a direction from the second operating position side to the first operating position side.

In accordance with the movement of the rocker arm shaft 14 preceding that of the left and right rocker arms 17 and 18, a predetermined force is accumulated in one of the springs 23 and 24. Thereafter, the left and right rocker arms 17 and 18 are moved to the corresponding operating position by utilizing the accumulated force.

According to this configuration, along with the movement of the rocker arm shaft 14 preceding that of the left and right rocker arms 17 and 18, it is possible to move the outer peripheral surface, where a foreign object has been prevented from being attached, to the side to which the left and right rocker arms 17 and 18 are about to be moved, and concurrently, to accumulate a force in one of the springs 23 and 24.

Moreover, the left and right rocker arms 17 and 18 are moved by utilizing a force accumulated in one of the springs 23 and 24. For this reason, the movement of the left and right rocker arms 17 and 18 is less likely to be influenced by an oil temperature and the like than the case of utilizing an engine oil pressure for the movement of the left and right rocker arms 17 and 18. As a result, the left and right rocker arms 17 and 18 can be smoothly moved.

In addition, the valve-actuating system 5 includes the rocker-arm-movement restricting mechanism 31. The rocker-arm-movement restricting mechanism restricts the movement of the left and right rocker arms 17 and 18 in the axial directions with respect to the cylinder head 2 until the predetermined force is accumulated in one of the springs 23 and 24.

Accordingly, the left and right rocker arms 17 and 18 are not moved before one of the springs 23 and 24 accumulates the predetermined force. As a result, the left and right rocker arms 17 and 18 can be smoothly moved by utilizing the force accumulated in one of the springs 23 and 24.

Moreover, the valve-actuating system 5 includes the first and second spring receiving collars 25 and 26. The first and second spring receiving collars 25 and 26 are disposed on the rocker arm shaft 14 so as not to be relatively movable in the axial directions, and engage respectively with the springs 23 and 24. When the movement of the left and right rocker arms 17 and 18 in the axial directions with respect to the cylinder head 2 is restricted, the rocker arm shaft 14 is moved in the axial directions with respect to the cylinder head 2 along with the spring receiving collars 25 and 26. The predetermined force is thus accumulated in one of the springs 23 and 24.

Accordingly, the predetermined force can be accumulated in one of the springs 23 and 24 by moving the rocker arm shaft 14 in the axial directions along with the spring receiving collars 25 and 26. In other words, utilizing the rocker arm shaft 14 as a part of the rocker-arm moving mechanisms 21 and 22 makes it possible to simplify the rocker-arm moving mechanisms 21 and 22.

It should be noted that the present invention is not limited to the above-described embodiment. For example, the present invention may employ a configuration in which the movement of the rocker arms is restricted, instead of by the trigger arm 33, by the rocker-arm moving mechanisms 21 and 22 until the corresponding one of the springs 23 and 24 accumulates a predetermined force. In addition, may be employed a configuration in which, instead of the spring receiving collars 25 and 26, spring-receiving portions, engaging respectively with the springs 23 and 24, are provided with the rocker arm shaft 14.

Moreover, each of the springs 23 and 24 may be a helical tension spring, a helical torsion spring, or a leaf spring. Alternatively, each of the springs 23 and 24 may be an elastic member other than a metallic member. Furthermore, may be employed a configuration in which the rocker arms are moved, not by two steps, but at once at the time of the fitting of the convex and concave profiles of the corresponding key portions, between the operating positions.

In addition, the engine to which the present invention is applied is not limited to the four-valve engine, but may be a two-valve engine, or a three-valve engine. The engine may be also one including a single rocker arm which is not relatively swingable, on each of the intake and exhaust sides in one cylinder. Moreover, the engine is not limited to a DOHC engine, but may be an OHC engine, or an OHV engine. Furthermore, the present invention may be applied to, instead of the four-cylinder engine, one of various types of reciprocating engines, such as a parallel multicylinder engine, a single cylinder engine, and a V-type multicylinder engine.

The configuration of the above-described embodiment is an example of the present invention, and therefore various modifications may be made without departing from the spirit of the present invention.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A valve-actuating system for an engine having an engine valve, said valve-actuating system comprising:

a camshaft;

a pair of first and second cams disposed on the camshaft, and being operatively associated with said engine valve;

a rocker arm shaft arranged parallel to the camshaft; and a rocker arm supported on said rocker arm shaft, said rocker arm being swingable around an axis of the rocker arm shaft, and being movable in an axial direction thereof, said rocker arm including left and right rocker arm segments which are independently operable relative to each other;

wherein:

said system is configured such that during an operation of the engine, in accordance with a rotational movement of the camshaft, the rocker arm abuts on one of the cams so as to be swung, thereby causing the engine valve to perform the opening and closing operations;

the rocker arm is moved, in the axial direction, to one of a first operating position, where the rocker arm is allowed to abut on the first cam, and a second operating position where the rocker arm is allowed to abut on the second cam, so that a corresponding one of the cams is selectively used for opening and closing the engine valve; and wherein the rocker arm shaft is supported by an engine frame, said rocker arm shaft being movable in the axial directions thereof; and when the rocker arm is about to be moved to a selected one of the first and second operating positions, the rocker arm shaft is moved in advance to said one of the first and second operating positions, and thereafter the rocker arm is moved to said one of the first and second operating positions.

2. The valve-actuating system for an engine according to claim 1, further comprising:

a first rocker-arm moving mechanism having a first spring for applying a force to the rocker arm in a direction from the first operating position side to the second operating position side; and a second rocker-arm moving mechanism having a second spring for applying a force to the rocker arm in a direction from the second operating position side to the first operating position side;

wherein during engine operation, a predetermined force is accumulated in one of the first and second springs in accordance with the movement of the rocker arm shaft preceding that of the rocker arm, and thereafter the rocker arm is moved to the corresponding operating position by utilizing said accumulated predetermined force.

3. The valve-actuating system for an engine according to claim 2, further comprising a rocker-arm-movement restricting mechanism, for restricting the movement of the rocker arm in the axial direction with respect to the engine frame until the predetermined force is accumulated in one of the first and second springs.

4. The valve-actuating system for an engine according to claim 2, wherein the first and second rocker-arm moving mechanisms respectively include first and second spring-receiving portions which are provided on the rocker arm shaft so as not to be relatively movable, and which engage one of the respective springs, and wherein, during the operation of the engine, when a movement of the rocker arm in the axial directions with respect to the engine frame is restricted, the rocker arm shaft is moved in the axial direction with respect to the engine frame along with the spring-receiving portions, so that the predetermined force is accumulated in one of the springs.

5. The valve-actuating system for an engine according to claim 3, wherein the first and second rocker-arm moving mechanisms respectively include first and second spring-receiving portions which are provided on the rocker arm shaft so as not to be relatively movable, and which engage one of the respective springs, and wherein, during the operation of the engine, when a movement of the rocker arm in the axial directions with respect to the engine frame is restricted, the rocker arm shaft is moved in the axial directions with respect to the engine frame along with the spring-receiving portions, so that the predetermined force is accumulated in one of the springs.

6. The valve-actuating system for an engine according to claim 1, wherein the rocker arm shaft is moved in advance to one of the first and second operating positions so as to minimize obstructions to movement of the rocker arm to said one of the first and second operating positions.

7. The valve-actuating system for an engine according to claim 1, wherein the rocker arm shaft is moved in advance such that even if a foreign object is present on a surface of the rocker arm shaft, said foreign object does not interfere with operative disposition of the rocker arm to one of the first and second operating positions.

8. The valve-actuating system for an engine according to claim 1, wherein said system is configured such that when a foreign object is encountered between the rocker arm and the rocker arm shaft, the foreign object is discharged appropriately by relative movements of the rocker arm and the rocker arm shaft.

9. The valve-actuating system for an engine according to claim 2, wherein said system is configured such that when a foreign object is encountered between the rocker arm and the rocker arm shaft, the foreign object is discharged appropriately by relative movements of the rocker arm and the rocker arm shaft.

10. A method of operating a valve-actuating system of an engine having an engine valve, said valve-actuating system comprising a camshaft, a pair of first and second cams disposed on the camshaft, said cams operatively associated with said engine valve, a rocker arm shaft and a rocker arm supported on said rocker arm shaft, said rocker arm including left and right rocker arm segments which are independently operable relative to each other, said method comprising the steps of:

a) determining a target operating position of the engine valve, said target operating position selected from a first operating position in which the rocker arm is allowed to abut on the first cam, and a second operating position in which the rocker arm is allowed to abut on the second cam;

b) moving said rocker arm shaft to said target operating position;

c) subsequent to the completion of step b), moving said rocker arm to said said target operating position; and d) subsequent to the completion of step c), engaging said rocker arm with a corresponding one of said first and second cams causing the engine valve to perform opening and closing operations.

11. A method of operating a valve-actuating system of engine according to claim 10, further comprising a step of discharging a foreign object encountered between the rocker arm and the rocker arm shaft by relative movements of the rocker arm and the rocker arm shaft.

12. A method of operating a valve-actuating system of engine according to claim 10, wherein the step of said moving said rocker arm shaft to said target operating position minimizes obstruction to movement of the rocker arm to said target operating position.

13. A method of operating a valve-actuating system of engine according to claim 10, wherein the step of moving said rocker arm shaft to said target operating position is done in a way which minimizes interference of a foreign object on a surface of the rocker arm shaft with the subsequent movement of the rocker arm.

14. A method of operating a valve-actuating system of engine according to claim 10, wherein said valve-actuating system further comprises a first rocker-arm moving mechanism having a first spring for applying a force to the rocker arm in a direction from the first operating position side to the second operating position side; and a second rocker-arm moving mechanism having a second spring for applying a force to the rocker arm in a direction from the second operating position side to the first operating position side;

wherein a predetermined force is accumulated in one of the first and second springs in accordance with the movement of the rocker arm shaft preceding that of the rocker arm, and thereafter the rocker arm is moved to the corresponding operating position by utilizing accumulated said predetermined force.

15. A method of operating a valve-actuating system of engine according to claim 10, wherein said valve-actuating system further comprises a rocker-arm-movement restricting mechanism which restricts the movement of the rocker arm in the axial directions with respect to the engine frame until the predetermined force is accumulated in one of the first and second springs.

16. An engine for a vehicle, said engine comprising:

a cylinder having an engine valve operatively associated therewith;

a cylinder head operatively attached to said cylinder;

a camshaft;

a pair of first and second cams disposed on the camshaft, and being operatively associated with said engine valve;

a rocker arm shaft slidably arranged in the cylinder head and disposed parallel to the camshaft; and a rocker arm supported on said rocker arm shaft, said rocker arm being swingable around an axis of the rocker arm shaft, and being movable in an axial direction thereof, said rocker arm including left and right rocker arm segments which are independently operable relative to each other;

wherein the system is configured such that during an operation of the engine, in accordance with a rotational movement of the camshaft, the rocker arm abuts on one of the cams so as to be swung, thereby causing the engine valve to perform the opening and closing operations;

the rocker arm is moved in the axial direction to one of a first operating position, in which the rocker arm is allowed to abut on the first cam, and a second operating position in which the rocker arm is allowed to abut on the second cam, so that a corresponding one of the cams is selectively used for opening and closing the engine valve; and wherein the rocker arm shaft is movable in the axial directions thereof; and when the rocker arm is about to be moved to selective one of the first and second operating positions, the rocker arm shaft is moved in advance to said selective one of the first and second operating positions, and thereafter the rocker arm is moved to said selective one of the corresponding said first and second operating positions.

17. An engine according to claim 16, further comprising:

a first rocker-arm moving mechanism having a first spring for applying a force to the rocker arm in a direction from the first operating position side to the second operating position side; and a second rocker-arm moving mechanism having a second spring for applying a force to the rocker arm in a direction from the second operating position side to the first operating position side;

wherein during engine operation, a predetermined force is accumulated in one of the first and second springs in accordance with the movement of the rocker arm shaft preceding that of the rocker arm, and thereafter, the rocker arm is moved to the corresponding operating position by utilizing said accumulated predetermined force.

18. The valve-actuating system for an engine according to claim 17, further comprising rocker-arm-movement restricting mechanism for restricting movement of the rocker arm in the axial directions with respect to the engine frame until the predetermined force is accumulated in one of the first and second springs.

19. An engine according to claim 16, wherein the engine is configured to move the rocker arm shaft in advance of axial movement of the rocker arm, such that even when a foreign object is present on a surface of the rocker arm shaft, said foreign object does not interfere with operative disposition of the rocker arm to one of the first and second operating positions.

20. An engine according to claim 16, wherein the engine is configured such that when a foreign object is encountered between the rocker arm and the rocker arm shaft, the foreign object is discharged appropriately by relative movements of the rocker arm and the rocker arm shaft.

* * * * *